US005139108A

United States Patent [19]

Pate

[11] Patent Number: 5,139,108

[45] Date of Patent: Aug. 18, 1992

[54] STABILIZED LADDER POWER WINCH SYSTEM

[76] Inventor: Ivan G. Pate, P.O. Box 11184, Knoxville, Tenn. 37939-1184

[21] Appl. No.: 671,214

[22] Filed: Mar. 1, 1991

[51] Int. Cl.[5] ..... E06C 7/12; E06C 7/48

[52] U.S. Cl. ..... 182/129; 182/108; 182/214

[58] Field of Search ..... 182/214, 107, 108, 129, 182/101, 102, 103

[56] References Cited

U.S. PATENT DOCUMENTS

| | | | |
|---|---|---|---|
| 156,541 | 11/1874 | Conrad et al. | 182/103 |
| 800,896 | 10/1905 | Biehler | 182/103 |
| 1,386,511 | 8/1921 | Krahl | 182/129 |
| 2,405,505 | 8/1946 | Kleidon | 182/103 |
| 2,459,621 | 1/1949 | Cobb | 182/129 |
| 3,074,508 | 1/1963 | Book | 182/129 |
| 3,115,211 | 12/1963 | Ostrander | 182/103 |
| 3,428,145 | 2/1969 | Lyon | 182/103 |
| 3,430,734 | 3/1969 | Embree | 182/103 |
| 4,128,228 | 12/1978 | Ziegelmann | 254/139.1 |
| 4,598,795 | 7/1986 | Larson | 182/129 |

*Primary Examiner*—Reinaldo P. Machado
*Attorney, Agent, or Firm*—Monroe Alex Brown

[57] ABSTRACT

A stabilized ladder power winch assembly includes a winch mounting subassembly with two channeled portions, a reversible mount bracket subassembly with a cantilevered portion, a tiltable prop subassembly having a safety rung support extension, a frame and corresponding and aligned handle and leg portions, and a stabilizer subassembly with lateral support portions. Each of the subassemblies is attached or mounted in combination with a conventional ladder for cooperating to raise an object from the ground or a base surface to the roof of a building or elevated surface. The winch mounting subassembly is mounted on a consecutive pair of rungs of a ladder and supports a conventional winch with a hoist line in a secure position for lifting an object. The reversible mount bracket subassembly is slid and guided into position over the upper portion of a ladder's siderails, and supports a conventional pulley unit to receive and transmit the hoist line from the winch supported on the winch mounting subassembly to the ground surface for use in lifting and lowering an object. The tiltable prop subassembly engages a rung of a ladder and extends the ladder away from a flat or slanted roof to permit an object being lifted from the ground to pass between the ladder and the building, and through and within the frame portion of the subassembly itself. The safety rung support extension portion has a backup safety channel for engaging a ladder rung if it slips from a primary support channel. The stabilizer subassembly has corresponding tracked portions to guide the support feet of a ladder into secure position and prevent movement of the ladder along any axis from its installed position.

10 Claims, 15 Drawing Sheets

STABILIZED LADDER POWER WINCH SYSTEM

BACKGROUND OF THE INVENTION

1. Field of the Invention

This invention relates to an improved ladder attachment apparatus which facilitates the lifting of objects and machinery from the ground and other surfaces to the roof of a building or other elevated position, and more specifically relates to a stabilized power winch system and assembly which can be used in combination and conjunction with a number of commercially available ladders to provide a stronger, more stabilized ability to position a ladder for more convenient lifting of objects ranging in weight up to considerably heavier objects for the purpose of transporting them to the roof of a building or other surface.

2. Background Information

Various types of ladder hoists, ladder hoist attachments, and ladder attachments facilitating the lifting of an operator or an object have been known or marketed for use by painting, maintenance and construction personnel. Typical of these inventions are U.S. Pat. Nos. 4,598,795; 4,128,228; 3,430,734; 3,428,145; 3,115,211; 3,074,508; 2,459,621; 2,405,505; 1,386,511; 800,896 and 156,541; which were located during the process of a patent search. Copies of all patents cited are enclosed pursuant to 37 C.F.R. §§1.97-1.99.

U.S. Pat. No. 4,598,795 issued to Larson relates to a ladder hoist attachment having a combination of a boom and a prop which is used with a conventional ladder, as they existed in 1985, to hoist loads preferably on to the roof of a building in the construction, roofing or air-conditioning trades. The boom assembly of Larson is provided with a number of feet that are designed to removably secure the boom to a rung of a conventional ladder being utilized. The boom extends horizontally over the top rung of the ladder with a number of braces connecting the feet and the boom. The boom assembly has a forward most brace which rests against the top rung of the ladder to provide support for the boom. A winch or pulley is suspended from the end of the boom to facilitate the lifting of a load. This invention discloses a hand operated winch or pulley system which is operated by the worker from the top of the building. The prop is provided with one end to be removably secured to one of the ladder rungs below the boom assembly. The other end of the prop has a vertical step to engage or catch only a square edge of a roof to hold the ladder away from this portion of the roof.

The Larson patent does not disclose or solve the problem of extending a ladder away from a building having a sloped roof. Nor does the Larson invention provide the other structural and functional advantages which exist in the present invention.

Specifically, Larson does not disclose or claim the mounting plate means and the winch/power means of the present invention. The ladder extension means of the present invention is structurally and functionally distinguishable from the prop of Larson, and will facilitate the ability to extend a ladder away from a sloped roof as well as a flat or square roof. Additionally, Larson does not utilize a ladder stabilization means, as the present invention does, to facilitate the safe positioning of the base of a ladder, and the lifting of substantially heavier objects to different elevated surfaces.

U.S. Pat. No. 4,128,228 issued to Ziegelmann on Dec. 5, 1978 discloses an extension ladder hoist having a hoist for raising and lowering articles from one elevation to another. It is designed to work in combination with a ladder which provides one portion of the necessary support for the apparatus. Ziegelmann is distinguishably different from the present invention structurally and functionally, and does not disclose or attempt to solve the problem of ladder base stability or the lifting of heavier objects. The Ziegelmann apparatus has no lower ladder stabilization means whatsoever. Ziegelmann further appears to disclose an apparatus which must be securely and fixedly attached to a roof portion., therefore, providing a positional disposition where its top support plate provides questionable stability with regard to the top of the ladder. Further, the means of interposing its frame member between the ladder and the roof is not disclosed clearly or specifically claimed in Ziegelmann.

U.S. Pat. No. 3,115,211 issued to Ostrander on Dec. 24, 1963 discloses a ladder hoist which is in part removably mounted as a carriage on the side rails of a conventional ladder, as they existed in 1961. This invention utilizes a spacing attachment 88 which is interposed between an upper rung of the ladder and a flat wall portion on the side of a building. Ostrander utilizes no mounting plate means as such, and employs no lower ladder stabilization means. Additionally, the spacing attachment 88 is structurally and functionally distinguishable from the ladder extension means of the present invention.

It should be emphasized that none of the prior art patent references cited disclose or claim directly or by equivalence an apparatus which has in combination the following elements: (1) mounting plate means; (2) winch/power means; (3) pulley block plate means; (4) ladder extension means and (5) lower ladder stabilization means. Additionally, the prior art is distinguishable structurally and functionally on an element-by-element basis.

None of the references specifically illustrates the present invention. Nor is the present invention obvious in view of any of the prior art references. In addition, all of the prior art heretofore known suffer from a number of disadvantages:

(a) The prior art devices do not address the problem of properly and securely stabilizing the lower or base portion of a conventional ladder so that the base will not slip in any direction under the substantially increased weight imposed on the ladder by lifting heavier objects, equipment and machinery, or the weight of a climbing person hand-carrying or lifting a heavy object or piece of equipment while climbing up or down the ladder. Additionally, the designs utilized in the prior art devices do not adequately address the problem of stabilizing the positioning of elements used to hoist or lift objects on the ladder itself.

(b) The prior art devices are not specifically designed to address the problem of providing a safe, removeable extension means having a safety slot system for holding an upper rung of a ladder in safe, supportable position while safely extending the ladder a comfortable, workable distance from a sloped or flat roof or surface to continently permit the passage of an object being raised or lowered in relation to the roof or surface.

(c) The prior art devices do not adequately solve the problem of providing safe, stable upper and lower support of a ladder when a worker is attempting to carry a heavy object up a ladder by hand from a ground surface to an elevated surface such as the top of a building or roof area.

(d) The prior art hoist systems do not address the problem of ladder base stabilization or stabilization of a hoist or lifting means.

(e) It is yet a further disadvantage of the prior art hoist devices that they do not adequately address the problem of safely being attached and secured to a conventional ladder, or being properly balanced relative and in combination with its relationship to the ladder.

(f) Additionally, the prior art devices do not adequately address the problem of being easily removeable from a conventional ladder and being conveniently transported to a work site.

(g) The prior art devices are further not specifically designed to safely lift heavier than average objects and equipment to elevated heights, or between spaced surfaces.

(h) Additionally, the prior art devices suffer from complexity of structure and movement of many moving parts to attempt to solve the problems related to lifting objects and heavy equipment.

(i) Further disadvantages in the structure and function of the prior art devices exist in their failure to adequately utilize advantageous support and lifting angles in the placement of support members and the lifting of objects.

(j) An additional disadvantage of the prior art is the absence functionally in the prior art devices of safely pivotable positioning of a ladder prop member or means to adequately facilitate the placement, support and secondary positioning of a ladder prop to adjust to changing work conditions such as allowing objects of different sizes to be lifted by a safe route between the wall or roof surface and the ladder positioned against it.

(k) Yet another disadvantage of the prior art devices is that they are not easily adoptable to the many diverse types of conventional ladders on the market, and often require specially constructed, non-conventional ladders and/or tracking or rail mechanisms.

(l) Additionally, the prior art hoist devices are not easily set up for operation by one person, but often require more than one person to facilitate operation in a work area.

(m) A further disadvantage of the prior art is the fact that these hoist devices are not adequately suited for a work person to remain on the ladder while an object is being lifted.

These and other disadvantages of the prior art will become apparent in reviewing the remainder of the present specification and the drawings.

Accordingly, it is an object of the present invention to provide a power winch system that has a means of securely stabilizing the lower or base portion of a conventional ladder so as to prevent the movement or slippage of this area when power lifting heavier objects or when equipment is carried up a ladder by hand.

It is a further object of the invention to have more stable positioning of each of its elements for lifting heavier objects; and to provide a safe removeable extension means which is provided with a safety slot backup system for holding the upper rung of a conventional ladder in supportable position while safely extending the ladder a distance from a sloped or flat roof surface to conveniently permit the passage of an object being raised between the ladder and the side of a building.

It is a further object of the present invention to provide both stable upper and lower support for a ladder during heavy power lifting, and when a worker is attempting to carry an object up a ladder by hand.

It is yet a further object of this invention to provide upper and lower hoist elements that are safely attached and secured to a conventional ladder., and which are easily removeable from the ladder and conveniently stored and transported to and from a work site.

It is a further object to provide a stabilized ladder power winch system which is specifically adopted and designed to safely lift heavier than average, and very heavy, objects and equipment from base (or ladder installation) surfaces to elevated surfaces, supporting and lifting such objects between a conventional ladder and the side or lateral surface of a building or other elevated structure.

Further objects of the invention are to provide a power winch system whose elements retain simplicity of structure and movement, and which utilize more advantageous support and lifting angles in the placement of its support elements and the lifting of objects and equipment.

An additional object of the present invention is to provide a ladder extension means which is safely pivotable to advantageously better facilitate the positioning, support and secondary positioning of a ladder extension member, so as to enable a worker faced with changing work conditions to adjust the position of a ladder or the space or distance between a ladder and the side surface of a building, for allowing objects of larger size to be lifted therebetween, and to the roof of a building.

Yet another object of the invention is to provide a power hoist system which is easily adopted and fitted to a number of diverse types of conventional ladders, without special additional equipment or changes to the structure of a conventional ladder itself.

An additional object of the present invention is to provide a power winch system which is easily set up and operated by one person, and which provides the unique ability for a person to remain on a ladder while an object is being lifted for partial periods of time should changing work conditions require this.

SUMMARY OF THE INVENTION

The foregoing and other objects can be achieved with the present invention assembly which is a stabilized ladder winch assembly which includes several novel subassemblies which work in relation to one another and in combination with their use with a conventional ladder. The winch mounting subassembly comprises two stiffly resilient wall portions which are attached to one another at a critical angle within a given angle range as described, and have respective channeled slots for attachment to an upper and lower rung of a consecutive pair of rungs on a ladder. A number of conventional winch units with hoist line can be secured on this subassembly and mountably supported in an advantageous position for lifting objects.

The reversible mount bracket subassembly has a flat, rigid back member, with a cantilevered portion and a pair of guide walls attached to the back for guideing and securing this subassembly for attachment to the top and upper portions of a ladder's siderails. This subassembly secures and supports a conventional pulley unit for transmitting the hoist line from the winch.

The tiltable prop means subassembly has a stiffly resilient frame member which may be trapazoidally shaped for advantagious use, and connecting of corresponding handle and leg extended portions for coordinating movement and support of the frame and a conventional ladder supported by the subassembly. This subassembly also has a novel safety rung support extension with primary and back-up support surfaces for supporting a conventional ladder from the top of the frame and allowing a worker to support the ladder in a position extended away from a building so that an object may be hoisted or lowered between the ladder and the building for placement on the roof or a ground surface. The corresponding handle and leg members of this subassembly are aligned in special and novel relationship to one another to facilitate the objects of the present invention.

DETAILED DESCRIPTION OF THE PREFERRED EMBODIMENT

Figure 1B:
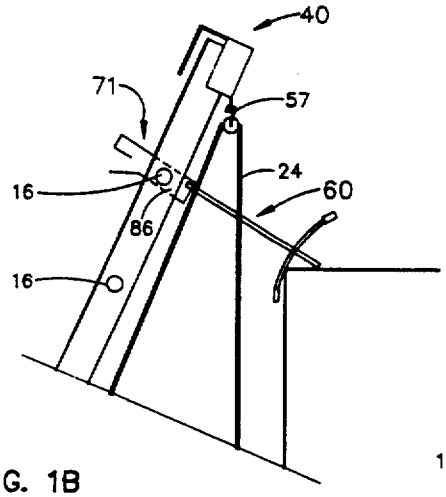
FIG. 1B is a detailed enlargement of a mount bracket subassembly illustrated generally as element 40 in FIG. 1.

The following description of some of the preferred embodiments of the concepts of this invention is made in reference to the accompanying figures. Where an individual structural element is depicted in more than one figure, it is assigned a common reference numeral for simplification of identification and understanding.

Figure 1:
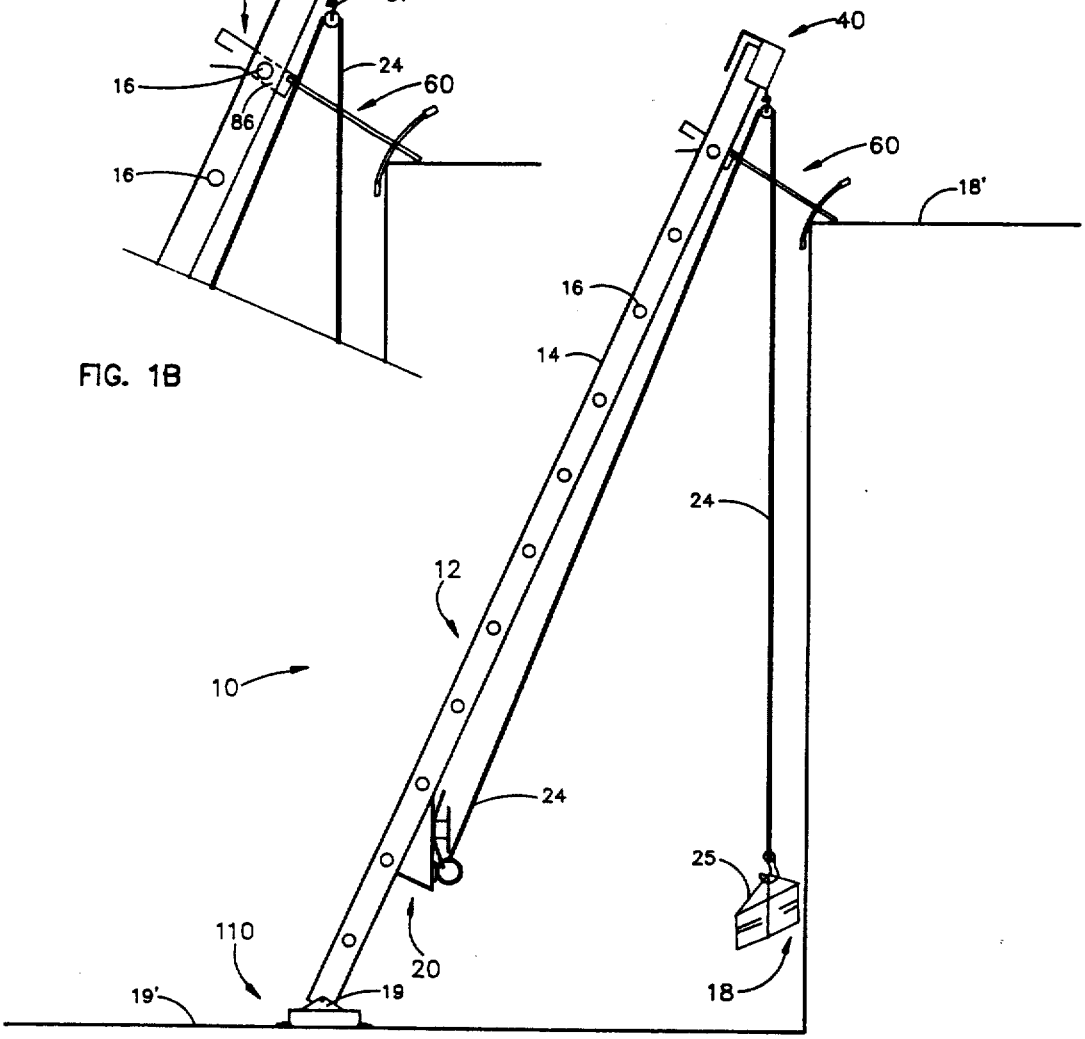
FIG. 1 is a substantially side view of a preferred embodiment of the novel stabilized ladder power winch system and assembly of the present invention.
Figure 1A:
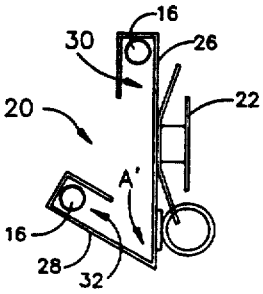
FIG. 1A is a detailed enlargement of a winch mounting subassembly illustrated generally as element 20 in FIG. 1.

Referring now to the drawings, and more particularly to FIGS. 1, 1A and 1B thereof, there is shown a stabilized ladder power winch assembly 10, which is constructed in accordance with the present invention, and which, as shown, is adopted to be used in attached combination with a conventional ladder or framework 12 having a pair of parallel lateral side rails 14, which are transversely connected by a series of rungs 16 which extend at intervals commonly found in many conventional ladders of about twelve (12) inches, the entire length of a one piece ladder, from its lower base end to its upper end. It will also be understood that conventional ladders are characteristically provided as two-piece extension ladders with two telescoped runged segments with the upper section being slid across the lower segment various ways to position the ladder for greater elevation against the side of a building shown generally at 18, extending to an elevated building roof surface 18'. Conventional ladders are also often provided with moveable support feet 19 for contact with a ground or ladder installation surface 19'.

The ladder power winch assembly 10 comprises a winch mounting subassembly 20, adopted to be mounted on a pair of consecutive rungs 16 preferably at a lower portion of the ladder 12, and to support any of a number of conventional power winch machine units 22 having a retractable hoist line 24 for lifting various equipment and other objects.

Figure 2:
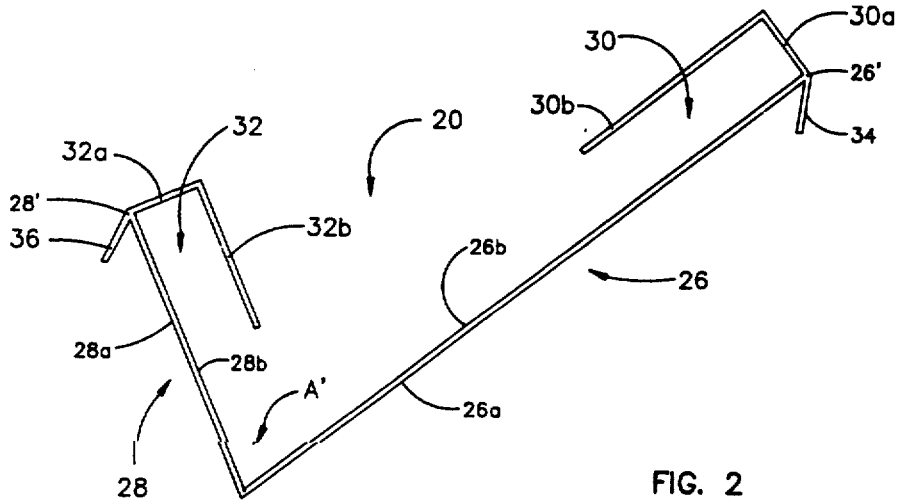
FIG. 2 is a side cross-section view of the winch mounting subassembly of the present assembly.
Figure 3:
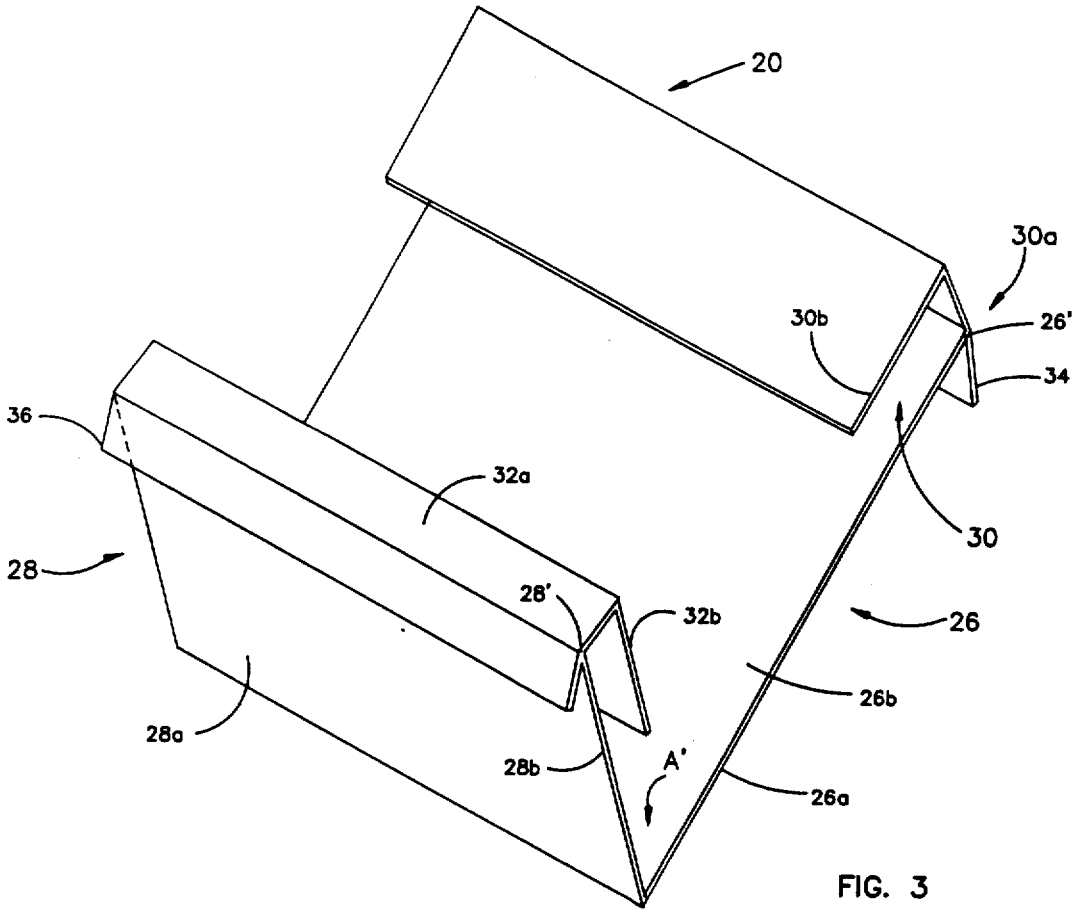
FIG. 3 is a bottom perspective view of the winch mounting subassembly of the assembly of the invention.
Figure 4:
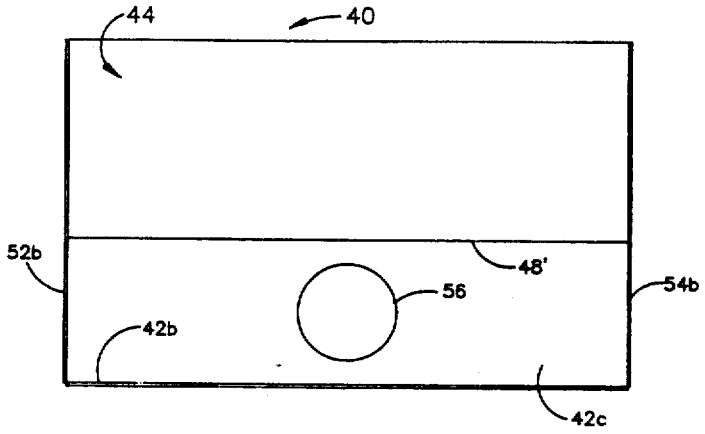
FIG. 4 is a top view of the reversible mount bracket subassembly of the present assembly.
Figure 5:
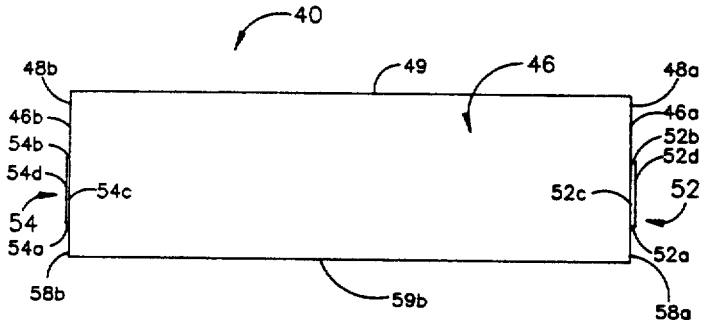
FIG. 5 is a back view of the reversible mount bracket subassembly.
Figure 6:
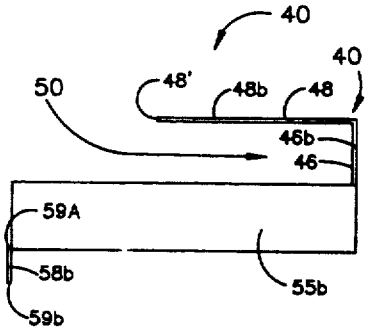
FIG. 6 is a side view of the mount bracket subassembly.

The winch mounting subassembly 20 is shown illustrated in preferred embodiments in FIGS. 1 and 1A also in FIGS. 2 and 3, and is constructed preferably of stiff resilient metal, plastic or wood composite. This subassembly 20 is provided with a first wall 26 and a second wall 28. The first wall 26 is preferably integrally attached to the second wall 28 so as to form an acute angle A' (A-prime) which is preferably equal to an angle from about 68 degrees to about 70 degrees (68°-70°). The angle A' is considered critical to the invention in that it facilitates the positioning and placement of the subassembly 20 on the rungs 16 of a ladder 12, and the position and support of a power winch 22.

The free end 26' of the first wall 26; that is, the end of the wall 26 which is not attached to the second wall 28; is formed to create and define an upper channeled slot 30. The free end 28' of the second wall 28 is formed to create and define a lower channeled slot 32. The upper slot 30 is substantially parallel to the first wall 26, and the lower slot 32 is substantially parallel to the second wall 28. The first wall 26 has an outside surface which is substantially flat for mounting of a power winch 22, and is adopted to face, when properly positioned, the side 18 of a building.

In a preferred embodiment of the invention the subassembly 20 further includes a first security flap member 34 which is attached as a separate element or integrally attached to a portion of the free end 26' of the first wall 26, as illustrated in FIGS. 2 and 3. The security flap member 34 extends away from the outside surface 26a of the first wall 26 at an angle of approximately 45 degrees (45°). The subassembly 20 also has a second security flap member 36 which is attached as a separate element or integrally attached to a portion of the free end 28' of the second wall 28, and extends away from the outside surface 28a of the second wall 28 at an angle of approximately 45 degrees (45°).

In an example of a preferred embodiment of the invention, the first wall 26 has a length of approximately 17.5 inches (17½"), and forms and defines an upper channeled slot 30 parallel to the inside surface 26b of the first wall 26. The upper channeled slot 30 has a short wall 30a which is perpendicular to the inside surface 26b of the first wall 26, and has a depth or width of approximately 1.75 inches (1¾") and has a long wall 30b which is parallel to the inside surface 26b of the first wall 26, and has a preferred length of approximately 5 inches (5"). Additionally, the second wall 28 has a length of about 7 inches (7") and forms and defines a lower channeled slot 32 which is parallel to the inside surface 28b of the second wall 28. The lower channeled slot 32 has a short wall 32a which is perpendicular to the inside surface 28b of the second wall 28 and has a depth or width of about 1.75 inches (1¾); and has a long wall 32b which is parallel to the inside surface 28b of the second wall 28, and has a preferred length of approximately 3.5 inches (3½"). Additionally, in a preferred embodiment the straight-lined distance between the free end 26' of the first wall 26 and the free end 28' of the second wall 28, that line or imaginer ne being opposite to the angle A' formed by the connection of wall and wall 28, is approximately 16 inches (16"). In the relationship of lengths established by the length of elements 30b, 30a, 26, 28, 32a and 32b a relative or proportional ratio of the lengths of these elements, or sides when the subassembly 20 is viewed from the side along an axis of the first wall 26, is found to have a relative ratio of approximately: 5:1.75:17.5:7:1.75:3.5. This ratio of elements or sides is critical to the invention and design of subassembly 20. Such a side view is shown at FIG. 2.

Figure 7:
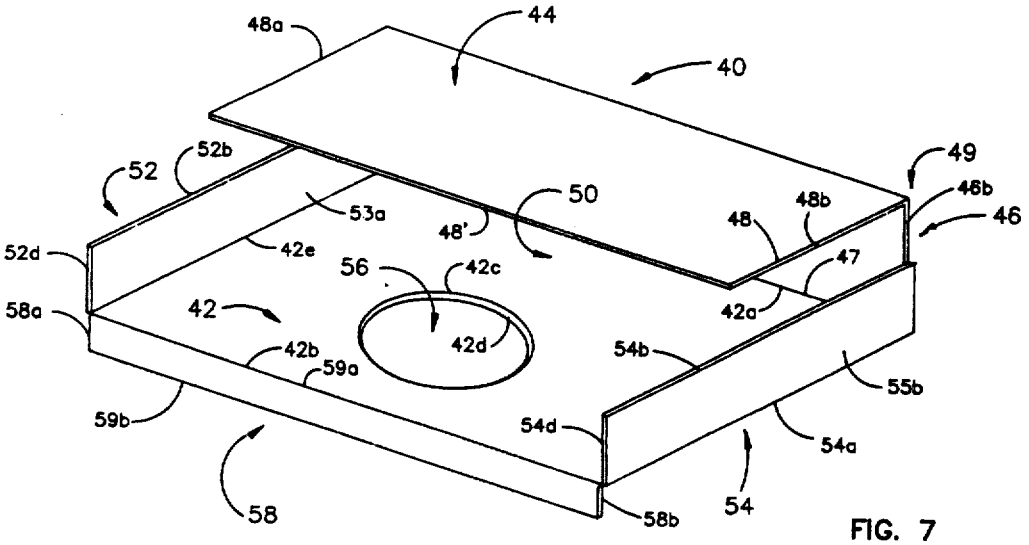
FIG. 7 is a top perspective view of the mount bracket

The power winch assembly 10 further comprises a reversible mount bracket subassembly 40, illustrated in FIGS. 1,1B,4,5,6 and 7-10. The bracket subassembly 40 is provided with a substantially flat and rigid back member 42, having a first end 42a, a second end 42b, an inside surface 42c, an outside surface 42d, a first side portion 42e and a second side portion 42f. The subassembly 40 is also provided with a cantilevered portion 44 which has a support member 46 and a projecting member 48 each of which is attached to one another as illustrated in FIG. 7 at 49 generally. Although the illustration at FIG. 7 shows the attachment 49 as being integral in nature, it will be appreciated that the support member 46 and the projecting member 48 can be attached to one another in various ways to form a fixed and stable attachment of the members.

The support member 46 has a first lateral surface 46a and a second lateral surface 46b, and the projecting member 48 has a first lateral surface 48a and a second lateral surface 48b. The first lateral surfaces 46a and 48a of the members 46 and 48 are integral and coterminal with each other and parallel and coterminal with the first side portion 42e of the back member 42. The second lateral surfaces 46b and 48b of the member 46 and 48, respectively, are integral and coterminal with each other and parallel and coterminal with the second side portion 42f of the back member 42.

The cantilevered portion 44 is attached as a separate part or integrally attached to the first end 42a of the back member. As illustrated in FIG. 7 the free end 47 of the of the support member of the cantilever portion 44 is attached to the first end 42a of 10 the back member 42. As indicated in describing earlier preferred attachments of elements, it is preferred that the cantilevered portion 44 be integrally and fixedly attached to the back member 44. The construction of the entire subassembly should, as in the case of the winch mounting subassembly 20, be constructed of stiffly rigid metal, metal alloy, plastic or polymer alloy or wood composite.

The cantilevered portion 44 by its fixed attachment to the back member 44, as described and illustrated, forms and defines a side-rail channel 50. The projecting member 48 of the cantilevered portion 44 is attached to the support member 46 at an angle of approximately 90 degrees (90°), and the support member 46 is attached to the back member as earlier described such that the projecting member 44 is parallel to the inside surface 42c of the back member 42. The channel 50 is, therefore, parallel to and spaced from the inside surface 42c of the back member 42.

The reversible mount bracket subassembly 40 further comprises a first guide wall 52 and a second guide wall 54. The first guide wall 52 has, as is characteristic of a wall or wall sheet element, first and second long lateral sides, 52a and 52b, respectively., first and second short lateral sides 52c and 52d, respectively., and inside and outside surfaces 53a and 53b, respectively. The second guide wall 54 similarly has first and second long lateral sides 54a and 54b, respectively; first and second short lateral sides 54c and 54d, respectively; and inside and outside surfaces 55a and 55b, respectively. The first long lateral side 52a of the first guide wall 52 is fixedly attached (as earlier set forth) to the first side portion 42e of the back member 42. The first guide wall 52 is fixed positionally so that it lies in a perpendicular relationship with the inside surface 42c of the back member 42. As illustrated in FIGS. 4-10 lateral sides 52a and 52b are parallel to each other, as is the relationship between lateral sides 52c and 52d, inside and outside surfaces 53a and 53b, lateral sides 54a and 54b, lateral sides 54c and 54d, and inside and outside surfaces 55a and 55b. When positioned, the lateral sides (short) 52c and 52d are of such a length that the first guide wall 52 extends perpendicular to the back member 42 to a point which is about midway between the projecting member 48 of the cantilevered portion 44 and the back member 42. This distance of extention is preferably a distance of about two inches (2"), but can vary to meet the needs of various conventional ladders.

Similarly, the second guide wall 54 is fixed positionally so that it lies in a perpendicular relationship with the inside surface 42c of the back member, with the first long lateral side 54a of the back member, with the first long lateral side 54a of the second guide wall 54 being attached in a fixed manner as indicated to the second side portion 42f of the back member 42. Also, when positioned, as indicated with reference to short lateral sides 52c and 52d, the short lateral sides 54c and 54d have a length extending the second guide wall 54 perpendicular to the back member to a point which is about midway between the projecting member 48 of the cantilevered portion 44 and the back member 42. This distance, as indicated with respect to the extended distance of the first guide wall 52, is preferably a distance of about two inches (2").

The back member 42 is further provided close to the second end 42b with a pulley connection space 56 for supporting and providing a connection space for a standard or conventional pulley unit 57 or means for feeding and transmitting a retractable hoist line 24 from a motorized power winch 22 for lifting an object from a ground surface 19' upon which a ladder 12 is installed, as illustrated in FIG. 1.

Additionally, in a preferred embodiment of the invention, the back member 42 of the subassembly 40 can be provided with a security dock member 58. The dock member 58 is a wall member having a rectangular-like shape with short lateral sides 58a and 58b of equal length and parallel to one another. The dock member 58 has a first long lateral side 59a and a second long lateral side 59b of equal length and parallel to one another, as is characteristic of a rectangular wall figure. The first long lateral side 59a of the dock member 58 is fixedly attached, or integrally formed with, the second end 42b of the back member 42. The long lateral sides 59a and 59b each have a length equal to the length of the second end 42b of the back 42 so that the short lateral sides 58a and 58b are even or coterminal with the boundaries of the first and second side portions 42e and 42f of the back member 42. The first long lateral side 59a of the dock member 58 is attached at the second end 42b of the back member 42 so as to form an angle in the approximate range of 90 degrees (90°) between the wall portion of the dock member 58 and the outside surface 42d of the back member 42.

In an example of a preferred construction of the mount bracket subassembly 40 the subassembly is constructed of ten (10) gauge steel and has the following dimensions:

The first and second ends 42a and 42b of the back member 42; the free end 47 of the support member 46; the free end 48' of the projecting member 48 and the point of attachment 49 of members 46 and 48; each have a length of approximately sixteen and one-half inches (16½"); additionally, the first and second long lateral sides 59a and 59b of the security dock member 58, each have a length of 16½";

the first and second long lateral sides 52a and 52b of the first guide wall 52, and the first and-second long lateral sides 54a and 54b of the second guide wall 54, together with the first-and second side portions 42e and 42f of the back member 42; each have a length of approximately ten inches (10");

the first and second lateral surfaces 46a and 46b of the support member 46, each have a length of approximately four inches (4");

the first and second lateral surfaces 48a and 48b of the projecting member 48, each have a length of approximately six inches (6");

the first and second short lateral sides 52c and 52d of the first guide wall 52, and the first and second short lateral sides 54c and 54d of the second guide wall 54, each have a length of two inches (2");

the short lateral sides 58a and 58b of the security dock member 58, each have a length of approximately three-quarters inches (¾"); and the pulley connection space 56 is defined or formed with a center point approximately midpoint along the length of the second end 42b of the back member 42 and about one and one-half (1½") inches up from said midpoint, and having an approximate diameter of about two inches (2").

Figure 12:
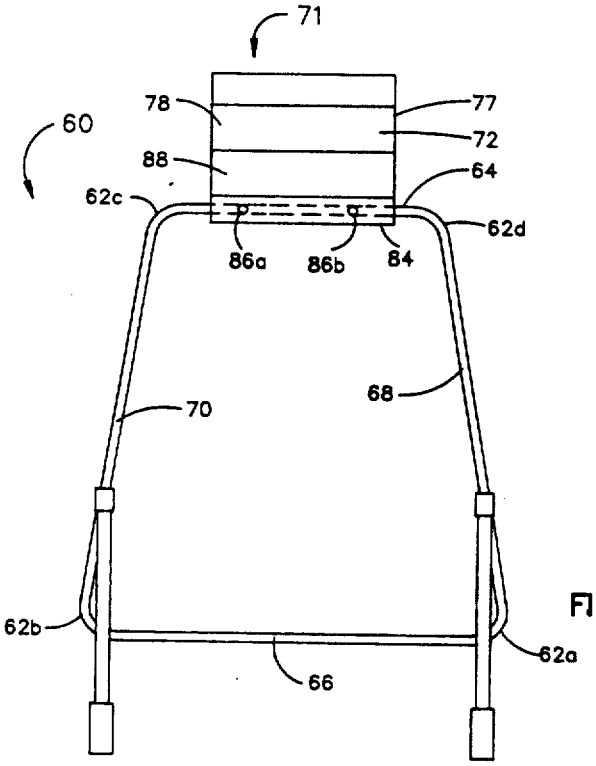
FIG. 12 is a front view of the tiltable prop subassembly.
Figure 11:
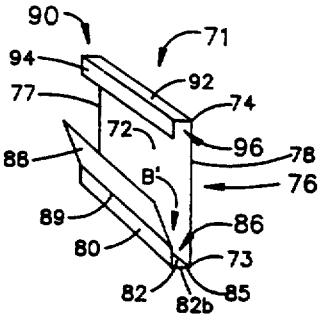
FIG. 11 is a side-front perspective view of the safety rung support extension of the tiltable prop subassembly of the present assembly invention.
Figure 13:
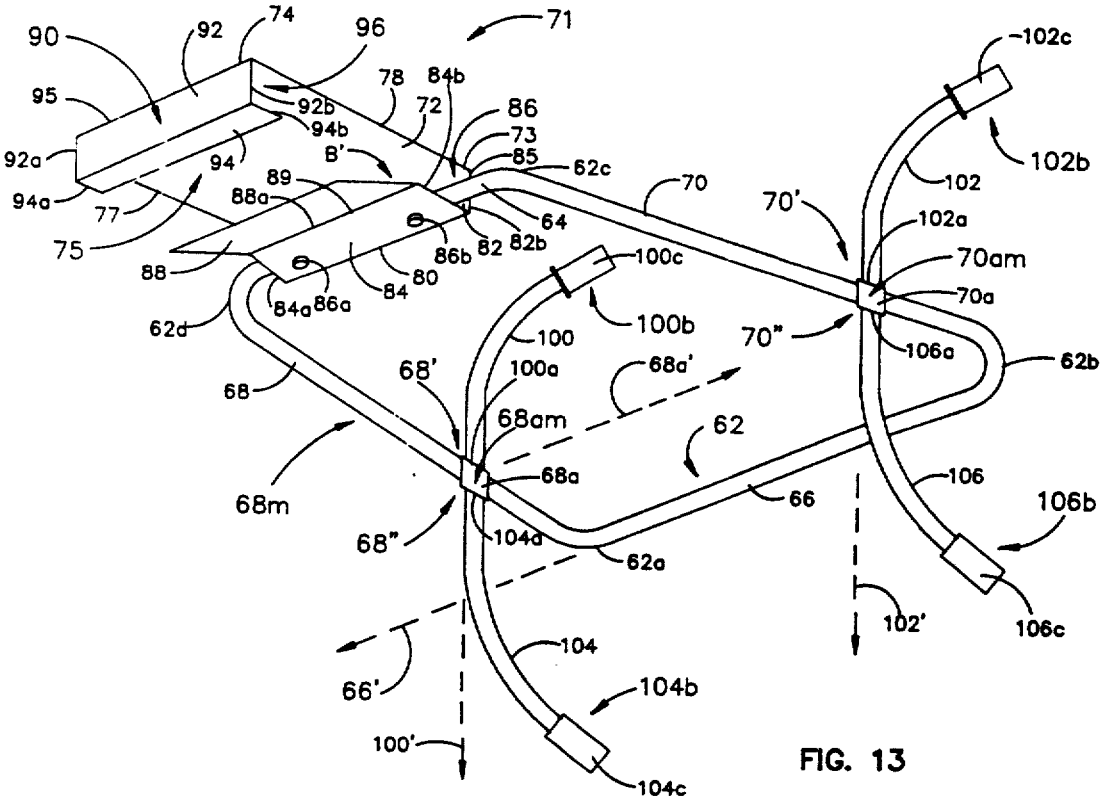
FIG. 13 is a perspective view of the tiltable prop subassembly of the invention.

The assembly 10 further comprises a tiltable prop means subassembly 60, illustrated in FIGS. 11, 12 and 13. The tiltable prop subassembly 60 is provided with a frame member 62 constructed preferably with a stiff or somewhat bending or bendable, resilient metal, although it will be understood that a number of various metal, polymer or composite/alloy materials can be used in constructing the frame and other elements of the subassembly 60.

The frame 62 has an upper horizontal bar and a lower horizontal bar, 64 and 66, respectively; and first and second side members, 68 and 70, respectively. The elements 64, 66, 68 and 70 are integrally connected with each other along a single common plane, or connected and attached as separate parts, at each of four (4) separate rounded or arcuate corners, as illustrated in FIG. 13, at 62a, 62b 62c and 62d, respectively constituting the first, second, third and fourth corners.

The upper horizontal bar 64 and the lower horizontal bar 66 are attached and connected at their respective corners so that each is parallel to one another; and preferably, the upper horizontal bar 64 is shorter in length than the lower horizontal bar 66. Additionally, in a preferred embodiment, the first and second side members 68 and 70 are of equal length.

The tiltable prop means subassembly 60 is further provided with a safety rung support extension means 71 having a substantially flat support wall 72 having a first end 73, a second end 74, an inside surface 75, an outside surface 76, a first lateral surface 77 and a second lateral surface 78, as is best illustrated in FIGS. 12 and 13, showing the support wall 72.

The safety rung support extension 71 further comprises a first cantilevered portion 80 which has a support member 82 and a projecting member 84. The support member 82 has first and second lateral surfaces 82a and 82b, respectively; and the projecting member 84 has first and second lateral surfaces 84a and 84b, respectively. The surfaces 82a and 84a are coterminal and surfaces 82b and 84b are coterminal; in alignment and boundaries as illustrated.

The support member 82 has a free end 85 which is the end, as illustrated, which is not attached to the projecting member 84. This free end 85 is integrally attached, or attached as a separate part, to the first end 73 of the support wall 72. The first cantilevered portion 80 when so positioned forms or defines a first channel 86. Additionally, the cantilevered portion 80 is fixedly attached to the upper horizontal bar 64 of the frame 62. This is shown illustrated at FIGS. 12 and 13 of the drawings. As illustrated therein, first and second bolt and nut, or bolt and secured or riveted cap, members 86a and 86b are shown generally. In this example of a preferred embodiment the bolt members 86a and 86b are shown passing through the projecting member 84, the upper horizontal bar 64 of the frame 62, and the flat support wall 72. It will, however, be understood that the cantilevered portion 80 can be fixedly secured to the upper horizontal bar 64 of the frame 62 by the use of many different forms of attachment and/or positioning as long as the safety rung support extension means 71 is fixedly supported substantially along the same plane that the frame 62 lies on, and the means 71 is fixedly and securely supported positionally above the upper horizontal bar, away from the lower horizontal bar 66, as illustrated positionally in FIGS. 12 and 13. 10 The projecting member 84 is additionally provided with a guide flap member 88. This projecting member 84 has a free end 89, which, as illustrated, is deemed to be the end which is not attached to the support member 82 of the cantilevered portion 80. The free end 89 of the projecting member 84 is integrally attached or formed, or separately attached, to a long lateral surface 88a of the guide flap 88. The guide flap 88 as illustrated constitutes a rectangular-like figure extended away from the support wall 72 similar to the configuration of a flap on an airplane wing tipped downward. Accordingly, the guide flap 88 extends down and away from the angular plane created by the inside surface 75 of the flat support wall 72, as illustrated in FIG. 13, at an acute angle B'. (B-Prime) relative to the inside surface 75, of approximately about 45 degrees (45°) to approximately about 60 degrees (60°).

The safety rung support extension means 71 is further provided with a second cantilevered portion 90 which has a support member 92 and a projecting member 94. The support member 92 has first and second lateral surfaces 92a and 92b, respectively; and the projecting member 94 has first and second lateral surfaces 94a and 94b, respectively. The surfaces 92a and 94a are conterminal and surfaces 92b and 94b are coterminal; in alignment and boundaries as illustrated.

The support member 92 has a free end 95 which is the end, as illustrated, which is not attached to the projecting member 94. This free end 95 is integrally attached, or attached as a separate part, to the second end 74 of the support wall 72. The second cantilevered portion 90 when so positioned forms or defines a second channel 96.

The frame member 62 is additionally provided with corresponding leg members and handle members, as illustrated in FIG. 13.

The first handle member 100 has first and second ends 100a and 100b. The first end 100a is fixedly and securely attached to a side portion 68' of the first side member 68 of the frame 62. In an example of a preferred embodiment, illustrated at FIG. 13, the side portion 68' is shown as an outside half of a tube-like or cylindrical bar frame 62. This side portion may also be in many other shapes depending on the configuration of the frame material or material used to construct the frame 62. Also illustrated in this example is a pipe or tube arm or fixture 68a, a part of the first side member 68, allowing the handle 100 to be threadably engaged therein to secure the handle 100 to the side portion 68'. One preferred type of fixture 68a is a pipe or tube collar which allows threadable engagement at different portions along a given axis. However, it will be understood that any number of various means of attachment; such as other special attachments, welding, other fixtures, integral molding and other secure attachment means; can be utilized to attach the handle 100 and other members later set forth herein to side portions of the frame 62 as long as the final positional alignment of members to be set forth is complied with to meet the novelty of the invention. Additionally, a side portion 68' and other side portions to be set forth herein may be an arcuate or circular portion, as illustrated by example in FIG. 13, or another positional portion of the side member 68 or side member 70 of the frame 62 to obtain the final positional alignment desired in the present invention.

The side portion 68' is positionally located at a point on the side member which is approximately about halfway between the midpoint 68m of the side member 68 and the horizontal plane 66' generated, or existing in an imaginery sense, from the positional plane of the lower horizontal bar 66 of the frame 62.

The second handle member 102 is also provided, having first and second ends 102a and 102b. The first end 102a of the second handle 102 is fixedly and securely attached as indicated to a side portion 70'. As similarly indicated with respect to handle 100, the first end 102a of the second handle 102 is shown by example as being attached to a tube arm or fixture 70a, a part of the second side member 70. The first end 102a of the second handle 102 is attached by part or integrally to the side portion 70' of the second side member 70, at a point on the side member 70 shown by example as the position of fixture 70a, as illustrated in FIG. 13, which is coplanar with the axis or plane generated horizontally by fixture 68a, as indicated generally at 68a'. In so positioning the first handle member 100 and the second handle member 102, these members additionally lie along parallel planes 100' and 102', respectively, which are perpendicular to the plane 66' of the lower horizontal bar 66.

Additionally, the frame 62 is provided with the first leg member 104 also having first and second ends 104a and 104b. The first leg 104 is securely attached at its first end 104a as indicated to a side portion 68'' of the first side member 68 and is positioned by this attachment so that the first leg 104 extends along and is coplanar with the plane 100' of the first handle member 100. This positioning substantially or completely mirror-images, in essence, the positional extension of the first handle 100.

The frame 62 is also provided with the second leg member 106 having first and second ends 106a and 106b. The first end 106a of the second leg 106 is fixedly and securely attached as indicated to the side portion 70'' of the second side member 70, at a point on the side 70 as illustrated and shown at the position of fixture 70a which is coplanar with the plane 68a' of the fixture 68a. This positioning also creates a configuration so that the second leg 106 extends along and is coplanar with the plane 102' generated as an imaginery line position or axis by the second handle member 102 so that the second leg 106, in essence, substantially or completely mirror-images the positional extension of the second handle 102.

By virtue of the positional alignment of the first and second handle members 100 and 102 and the first and second leg members 104 and 106, and their respective positional relationship to their respective points of attachment and the frame, a relationship and 10 definite configuration of the members is set forth which is part of the present invention. This relationship is set forth and comprised in the relationship of points established by: the second end 100b of the first handle 100 and the second end 104b of the first leg 104; the plane 68a' or imaginery line extending from the fixture 68a which for these purposes is deemed to extend from a midpoint the points of attachment of the first handle 100 and 68am between the points of attachment of the first handle 100 and the first leg 104 on the first side member 68 of frame 62; and a point established by the horizontal plane 66' of the lower horizontal bar 66. These points or imaginery points created as indicated substantially form a set of imaginery vertices of a rhomboidal figure, when viewing these points from the first side member 68 of frame 62 along the plane 66' of the lower horizontal bar 66.

Figure 14:
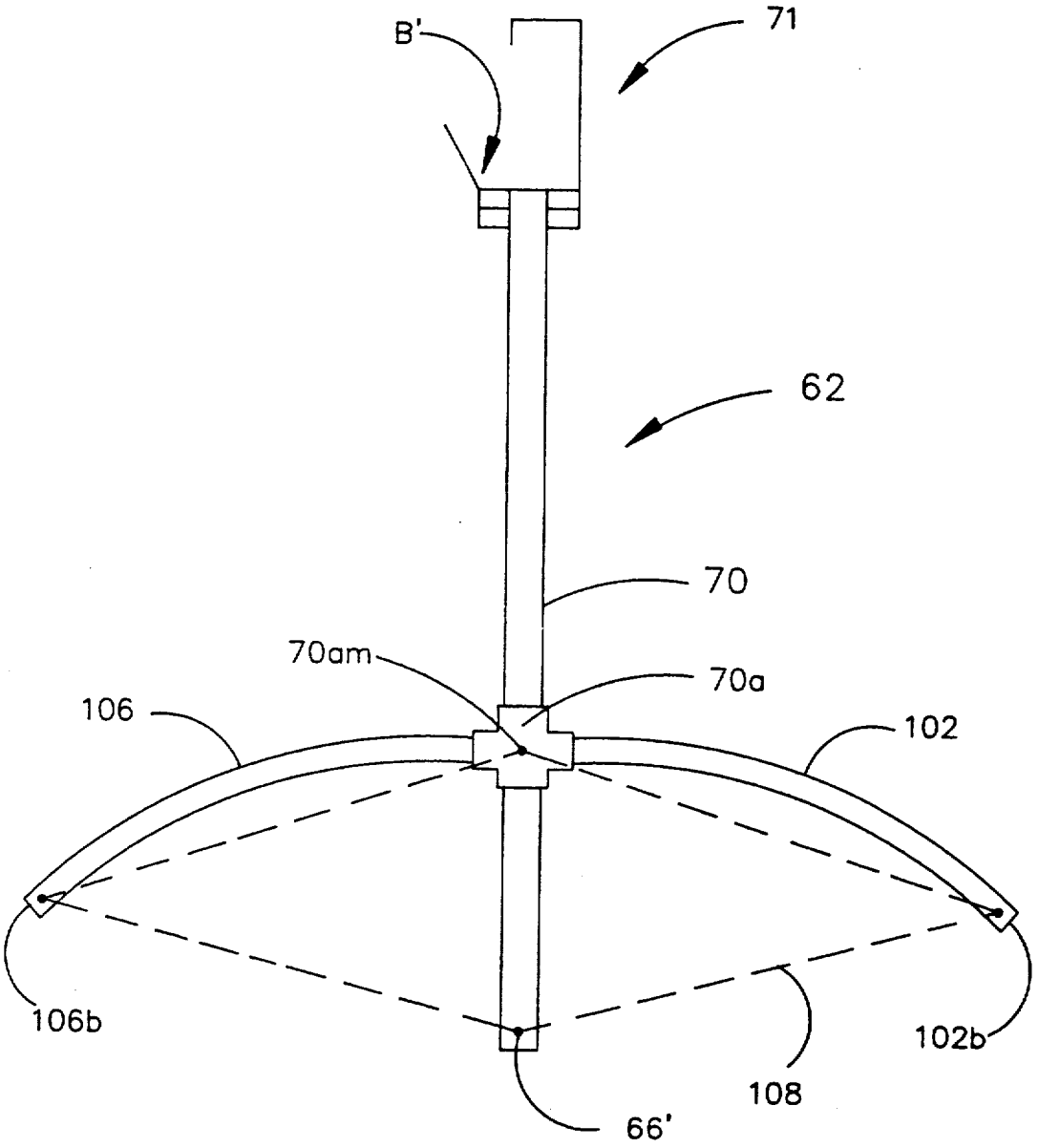
FIG. 14 is a side view of the tiltable prop subassembly indicating in phantom the imaginery rhomboidal configuration of the detailed points of alignment of the handle, leg and frame portions of the subassembly.

Correspondingly, the relationship set forth and comprised in the relationship of points generated by the second end 102b of the second handle 102 and the second end 106b of the second leg 106; the plane 68a' extending through the fixture 70a at the midpoint 70am deemed to be the midpoint between points of attachment of the second handle 102 and the second leg 106 on the second side 70 of frame 62; and a point established by the plane 66' of the lower horizontal bar 66. These points generated as indicated substantially form a set of imaginery vertices of a rhomboidal or rhomboid-like figure 108 shown generally by phantom lines, when viewing these points from the second side member 70 of frame 62 along the plane 66' of the lower horizontal bar 66, generally illustrated in FIG. 14.

By virtue of the configuration and position of the frame 62, leg members 104, 106 and arm members 100, 102; the tiltable prop means subassembly 60 is self-supporting in a slanted generally vertical position, when the frame 62 is tilted by a worker to rest on the second ends 104b and 106b of the first and second leg members 104 and 106; and is also self-supporting when the frame 62 is tilted by a worker to come to rest on the second ends 100b and 102b of the first and second handle members 100 and 102.

Additionally, FIGS. 12 and 13 illustrate the second ends 104b and 106b of the legs 104 and 106 as preferably being provided with a rubber or polymer support tip 104c and 106c respectively, each of which preferably fits over the respective end and slides into secure position. Similarly, the second ends 100b and 102b of the handles 100 and 102 respectively are preferably provided with a rubber or polymer handle grip 100c and 102c respectively, each of which also preferably fits over each of the respective ends and slides into secure position so that each grip will not slip during use.

The invention 10 may also include in a preferred embodiment the stabilizer means 110. The stabilizer means 110 is illustrated in FIGS. 1, and 15 through 20. The stabilizer 110 is positioned on the ground or installation surface 19' where a ladder 12 is to be installed for channelably engaging and securing a pair of support feet 19 of a ladder 12 and providing fixed and secure support against positional vibration or movement of the ladder along an x, y, z or other axis relative to the ladder's initial secured position on the stabilizer 110.

The stabilizer means 110 comprises a substantially flat guide support member 112 having first and second ends 112a and 112b respectively, first and second lateral sides 112c and 112d respectively, and inside and outside surfaces 112' and 112" respectively. The stabilizer is also provided with a first cantilevered portion 114 and the second cantilevered portion 116. The first cantilevered portion 114 has a support wall 114a and a projecting member 114b, and the second cantilevered portion 116 has a support wall 116a and the projecting member 116b. The support wall 114a of cantilever 114 is attached in part or integrally molded to attachment at its free end 114' with the first lateral side 112c of the guide support 112. Correspondingly, the support wall 116a of cantilever 116 is attached in part or integrally molded to attachment at its free end 116'. In positioning each of the cantilevered portions during the process of attachment or molding, each of these portions 114 and 116 are positioned in attachment so that each projecting member 114b and 116b is parallel with the vertical plane 117 of the outside surface 112" of the guide support 112. Additionally, the cantilevered portions 114 and 116 form and define a vertical channel 118 between the first end 112a and the second end 112b of the guide support 112.

The inside and outside surfaces 112' and 112" of the guide support 112 are cut or formed to define along a horizontal midpoint portion of the guide support 112 an evenly spaced track engagement space 120. Additionally, further spaces 121 and 122 are formed or defined from surfaces 112' and 112" along further evenly displaced portions of the horizontal length of the guide support 112.

Figures 15, 16, 17, 18, 19:
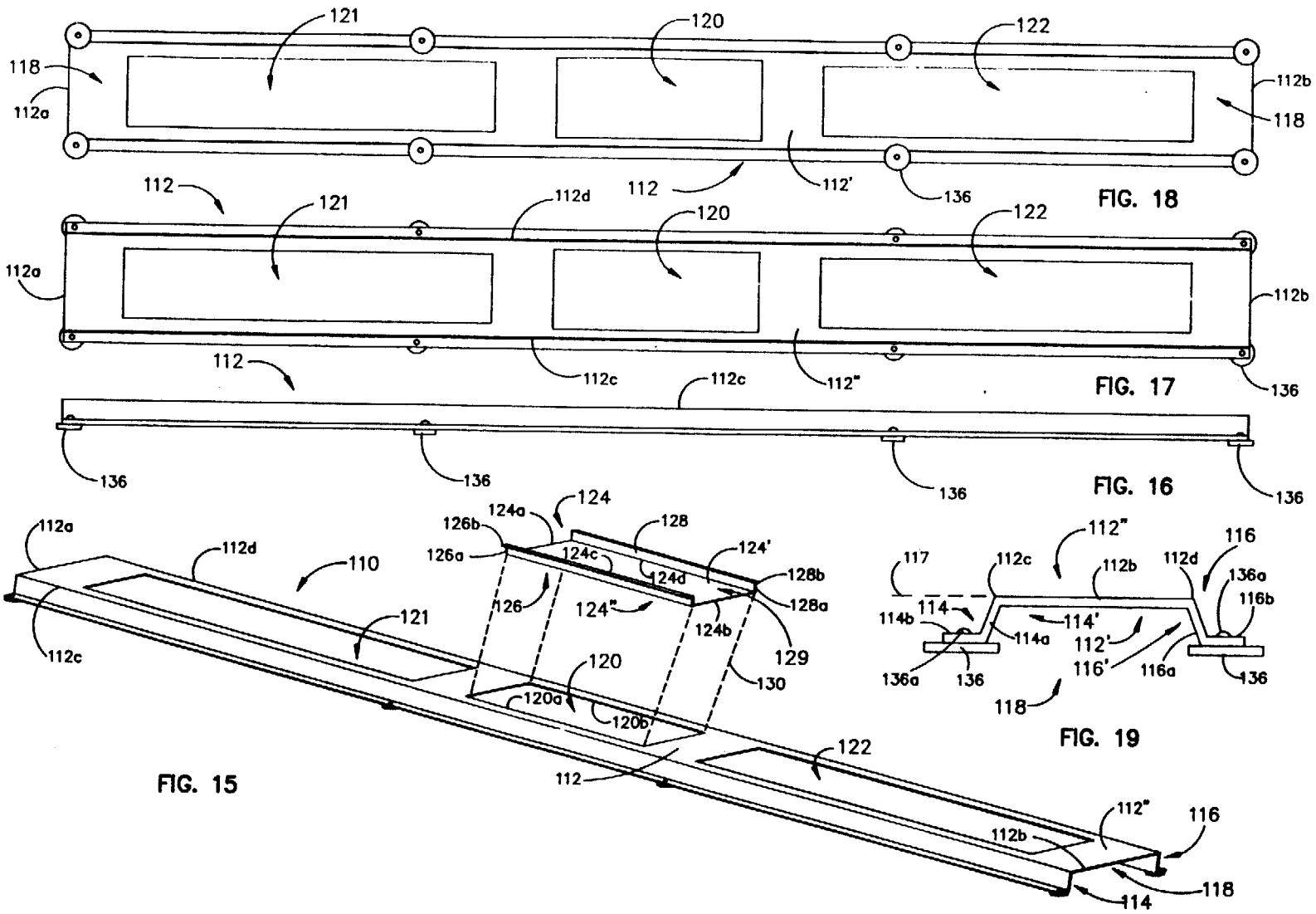
FIG. 15 is a perspective of the stabilizer subassembly of the present invention assembly, indicating in phantom the placement of the guide track member on the guide support of the subassembly.
FIG. 16 is a side view of the guide support of the stabilizer subassembly of the invention.
FIG. 17 is a top view of the guide support.
FIG. 18 is a bottom view of the guide support.
FIG. 19 is an end view of the guide support, viewed from the second end of the guide support of the subassembly.

The stabilizer 110 further comprises a substantially flat guide track member 124. The guide track 124 has first and second ends 124a and 124b respectively, side portions 124c and 124d and inside and outside surfaces 124' and 124" respectively, as illustrated in FIG. 15. Additionally, the first track cantilever portion 126 and the second track cantilever portion 128 are each provided with a support wall, 126a and 128a respectively, and a projecting member, 126b and 128b respectively; and as was the case with regard to the guide support 112, the free end of each of the support walls 126a and 128a is integrally attached to each of the side portions 124c and 124d, or attached as separate parts as previously set forth. The track cantilever portions 126 and 128 form and define a guide channel 129 on the inside surface 124' of the guide track 124 between the first and second ends 124a' and 124b of the track 124. The outside surface 124" of the guide track member 124 is engaged and inserted within the track engagement space 120 of the guide support member 112 by inserting the cantilevered portions 126 and 128 into the horizontal sides 120a and 120b of the track engagement space 120, as generally indicated in phantom at 130. In this manner the guide track member 124 is fixed and secured within the track engagement space 120 of the guide support member 112. It will be understood that there are many ways to insert, fix or engage the track member 124 on to and within the guide support 112, and that the guide track 124 can be inserted or attached as a separate piece or installed or attached by welding and many other means, or molded integrally, so that it is securely placed in position on the guide support 112 to receive the feet 19 (support feet) of a ladder 12, for ultimate positioning and stabilization.

Figure 20:
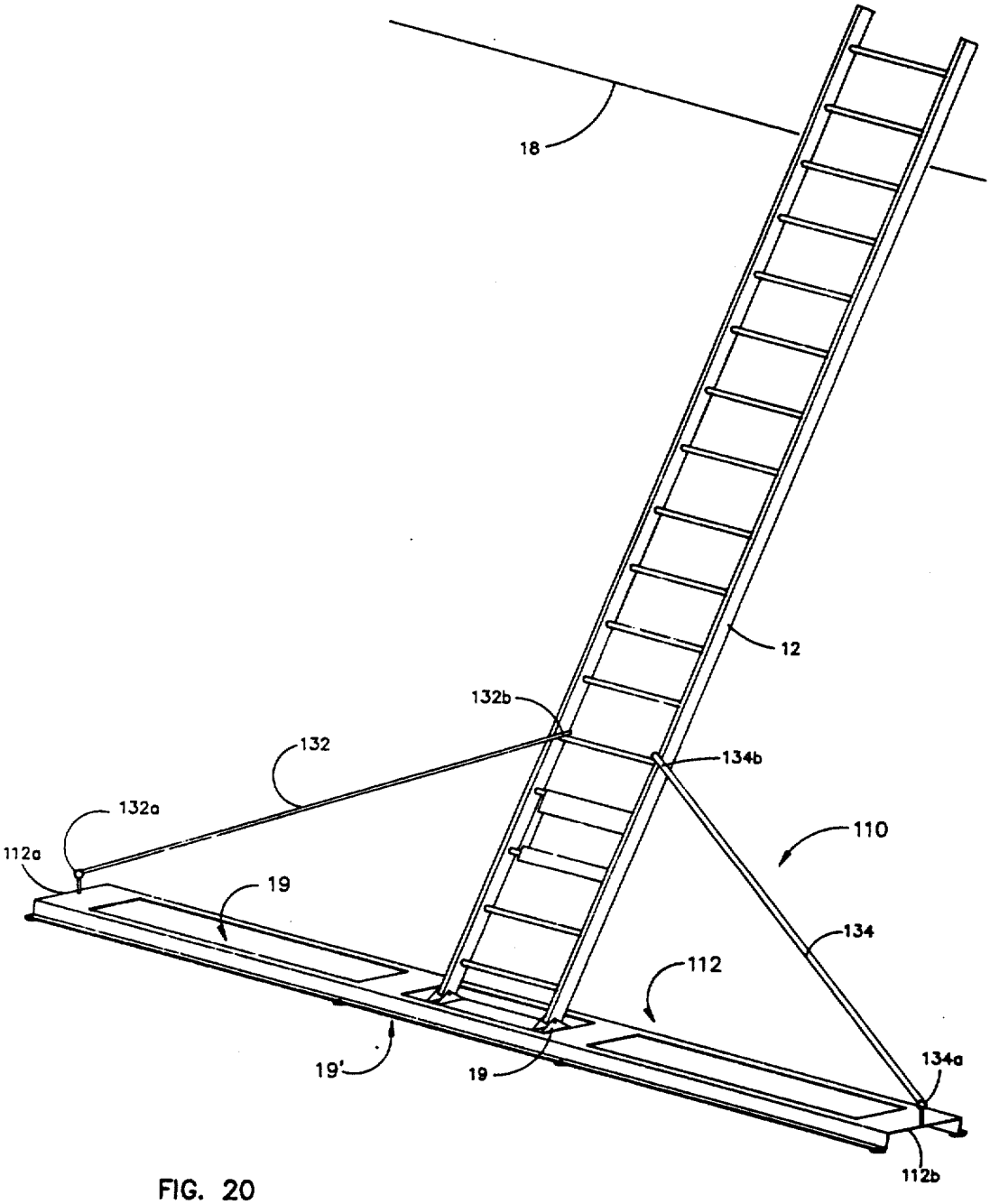
FIG. 20 is a perspective of the stablizer subassembly of the assembly, installed and illustrated individually on a conventional ladder as the ladder leans directly against a building, not showing the other subassemblies of the present invention.

The guide support member 112 is additionally provided in a preferred embodiment of the invention with the first flexible support member 132 and the second flexible support member 134, each of which has first and second ends 132a and 132b, and 134a and 134b, respectively, as best illustrated in FIG. 20. The first end 132a of the flexible support 132 is attached and securely fixed at the first end 112a of the guide support 112 and the second end 132b of the support 132 is fixed and secured to the nearest siderail 14 of a ladder 12, shown in FIG.

20 as the left siderail as one is viewing the front of the ladder 12. Correspondingly, the first end 134a of the flexible support 134 (second flexable support) is attached and securely fixed to the second end 112b of the guide support 112 and the second end 134b of the flexible support 134 is fixed and secured to the other siderail 14 of a ladder 12, shown in FIG. 20 as the right siderail of the ladder 12. A metal or polymer material may be used to construct the support members 132 and 134. By example of a preferred material a chain link material or product may be utilized as each of the support members 132 and 134, or any of a number of stiffly flexible alternative materials may be employed for this purpose. Additionally, there are a number of various ways to secure each of the respective ends 132a, 132b, 134a and 134b of the respective supports 132 and 134 to the guide support 112 and the siderails 14 of a ladder, as set forth so that secure lateral support is provided to the siderails 14 of the ladder 12 through the support of the guide support member 112.

The guide support member 112 is also provided in a preferred embodiment with a series or plurality of stiffly flexible support pads 136, as illustrated best in FIGS. 16, 17 and 18, and 19. The pad 136 is riveted, bolted or otherwise securely attached to the projecting members 114b and 116b at regular or spaced intervals along the horizontal length of the guide support member 112. By example, in FIG. 19, a rivet cap or bolt 136a is shown securing a support pad 136 to each of the respective projecting members 114b and 116b of the cantilevered portions 114 and 116. Each of the support pads is secured in concert with each other at a depth and in a position so that the guide support 112 is supported parallel with ground or installation surface 19' for even and consistently parallel support of the ladder feet 19.

In an example of a preferred embodiment of the assembly, and specifically the stabilizer means 110, also deemed herein to be the stabilizer subassembly 110 of the assembly invention 10, a series of dimensions are set forth for exemplary purposes only, in so far as a given set or series of dimensions which have been found to work well with the use and in combination with the use of a conventional ladder 12.

In this exemplary illustration of a series of preferred or possible preferred dimensions to be utilized, the stabilizer subassembly 110 may be constructed from 12 (twelve) gauge black steel, and the following dimensions, or approximate variations thereof, may be utilized as follows:

The length of the guide support member 112, from its first end 112a to its second end 112b is about 120" (inches), the width of the guide support 112 from the first lateral side 112c to the second lateral side 112d is about 10" (inches);

the length of each of the support walls 114a and 116a respectively of the first and second cantilevered portions 114 and 116 is about 120", and the depth of each of the support walls is about 2";

correspondingly, the length of the projecting members 114b and 116b respectively of the cantilevered portions 114 and 116 is 120", and the width of members 114b and 116b is about 1" (inch);

the track engagement space 120 has dimensions of about 8" width by 21" length, and is cut, formed or defined positionally to extend evenly from the midpoint of the length of the guide support 112, or at a point 60" from the first end 112a and 60" from the second end 112b, extending 10.5" (inches) from this midpoint, lengthwise in each direction toward each end 112a and 112b, and the engagement space is further positioned widthwise so that each of the horizontal sides 120a and 120b are parallel with the lateral sides 112c and 112d and about 1" from sides 112c and 112d, respectively;

the further spaces 121 and 122 are positioned by example so that space 121 has dimensions of about 37.5" length and about 7" width, this space 121 being formed, cut or defined about 6" from the first end 112a of the guide support 112 and extending 37.5" from this point in rectangular dimensions as set out so that the long sides are parallel to and 1.5" from the lateral sides 112c and 112d respectively, and the short sides are parallel to and six inches from the first end 112a and parallel to and 76.5" from the second end 112b respectively; additionally the short sides of the space 121 are parallel to the short sides of the track engagement space 120, and from left to right, as illustrated in FIG. 15, 43.5" and 6" from the first short side of the space 120, respectively; correspondingly, space 122 has the same rectangular dimensions as space 121 and is positioned so that its midpoint axis is 24.75" from the second end 112b of the guide support 112 and 95.25" from the first end 112a of support 112, and this axis is also positioned so it is equally 5" respectively from the first lateral side 112c and the second lateral side 112d of the guide support 112;

correspondingly, the guide track member 124 has dimensions where the length is about 21" and the width is about 8", i.e., the length from the first end 124a to the second end 124b is approximately 21" and the width from or between the side portions 124c and 124d is approximately 8"; the inside and outside surfaces 124' and 124" are parallel to each other and substantially flat; each of the supports walls 126a and 128a of the first and second track cantilevered portions 126 and 128 respectively are perpendicular to and inside surface 124' of the track 124 and have a depth of about 1.5" and a length of about 21", and correspondingly each of the projecting members 126b and 128b of the cantilevered portions 126 and 128 respectively has a length of 21" and a width of approximately 0.5" (½ inch); the support walls 126a and 128a may also be generally or approximately perpendicular to the guide track 124 so as to create a biasing or tighter fixed fit to the long sides of the track engagement space 120.

Figure 21:
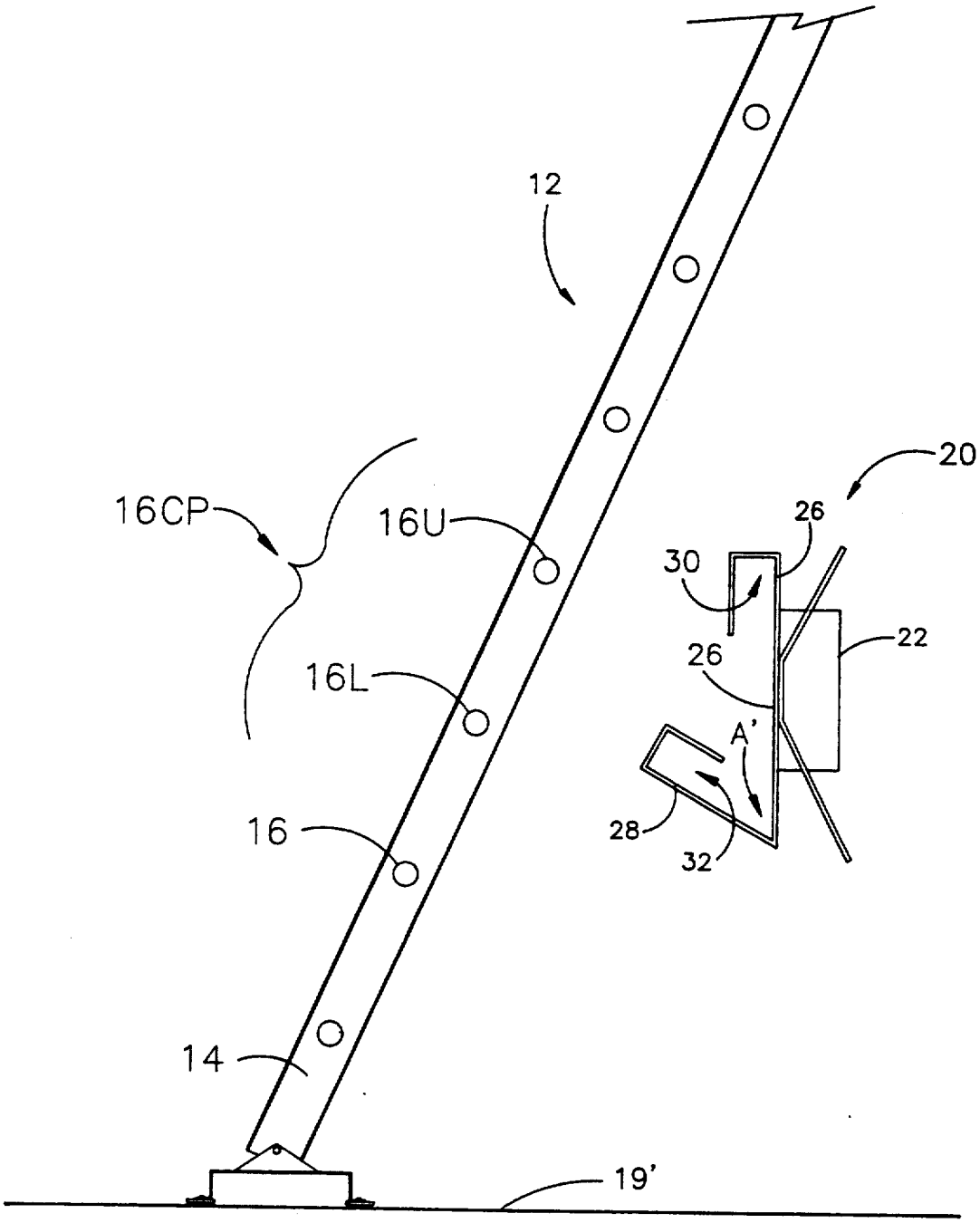
FIG. 21 is a side view illustrating a step of the process of installing the winch mounting subassembly on a conventional ladder.
Figure 22:
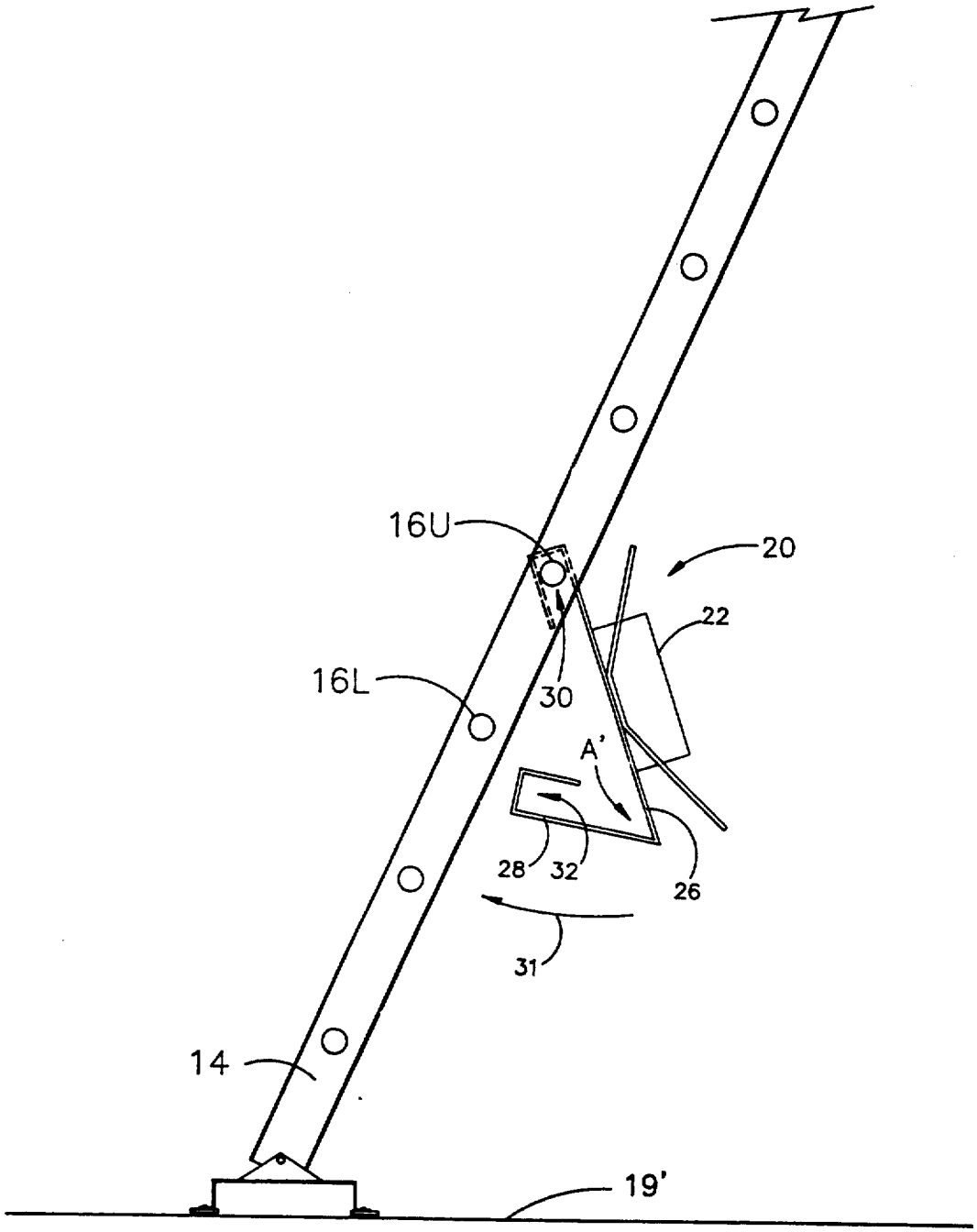
FIG. 22 is a side view illustrating the next consecutive step of the process of installing the winch mounting subassembly on a conventional ladder.

A preferred process of installing the winch mounting subassembly 20 is illustrated in FIGS. 21 through 25, which accentuates the advantages and novelty of the assembly 10. As illustrated in FIG. 21, the winch mounting subassembly 20 having a power winch machine unit 22 mounted and secured to the subassembly is positioned separately from the ladder 12 so as to address generally or substantially a lower rung 16L and an upper rung 16U, respectively, of a consecutive pair of rungs 16CP on a ladder 12, so that the lower channeled slot 32 and the upper channeled slot 30 open to, face or address the selected consecutive pair of rungs 16CP. The upper channeled slot 30 of the winch mounting subassembly 20 is then loopably or slotably attached and engaged over the upper rung 16U of the rung pair 16CP so that the rung seats securely into the channeled slot 30, as illustrated in FIG. 22. In so doing this will seat the rung 16U at the bottom or short wall 30a of the upper channeled slot 30, or at the full depth of the upper channeled slot 30. Preferrably and ideally, but by example only, a worker would raise the winch mounting subassembly 20 once the upper channeled slot 30 was first engaged with the upper rung 16U an angle of about 45° (degrees) from the axis of the ground horizontal 19' to achieve the suggested full depth of the upper channeled slot 30, but it will be appreciated that other types of positional movements can aid and facilitate this proper positioning.

Figure 23:
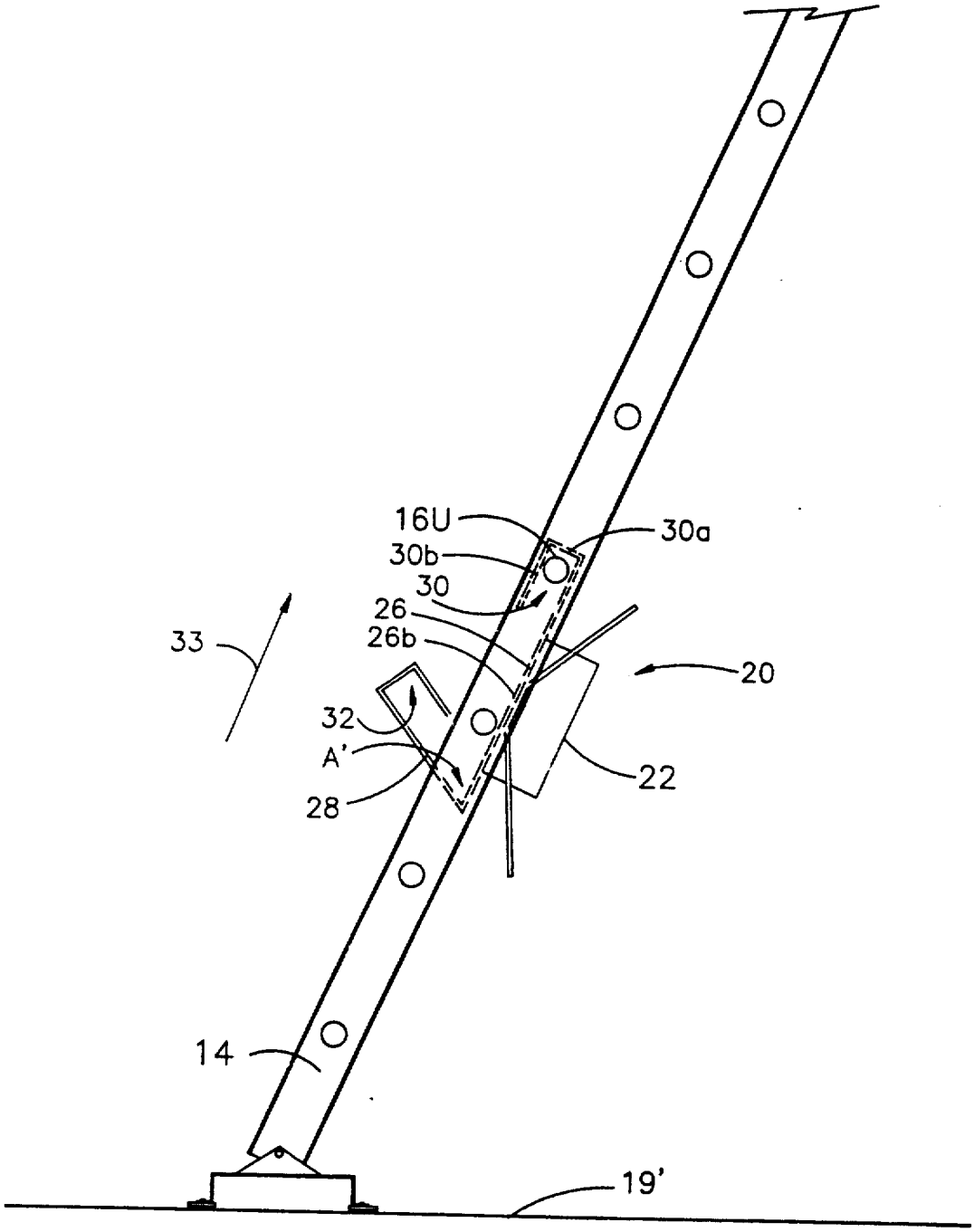
FIG. 23 is a side view illustrating the next consecutive step of the process of installing the winch mounting subassembly on a conventional ladder.
Figure 24:
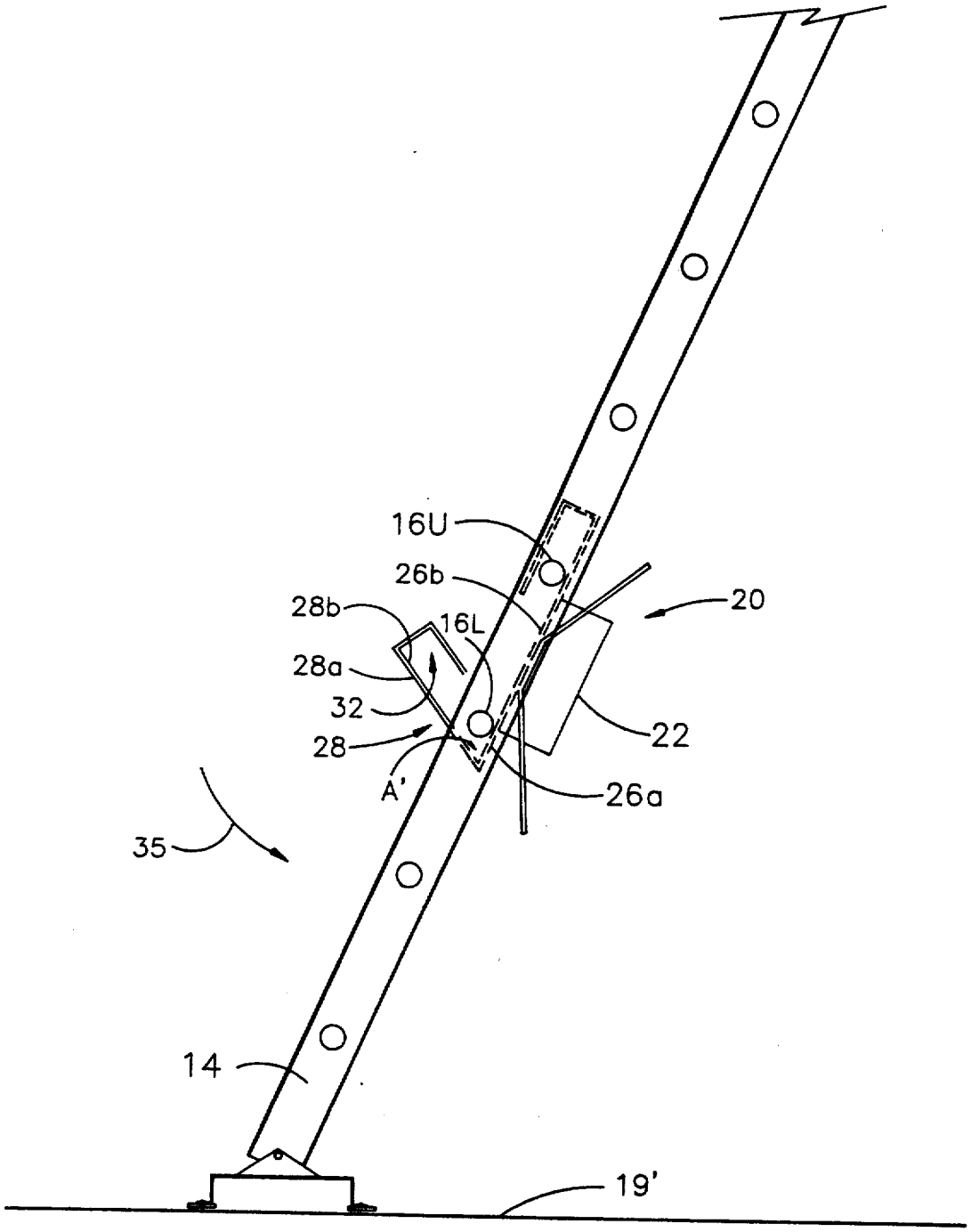
FIG. 24 is a side view illustrating the next consecutive step of the process of installing the winch mounting subassembly on a conventional ladder.
Figure 25:
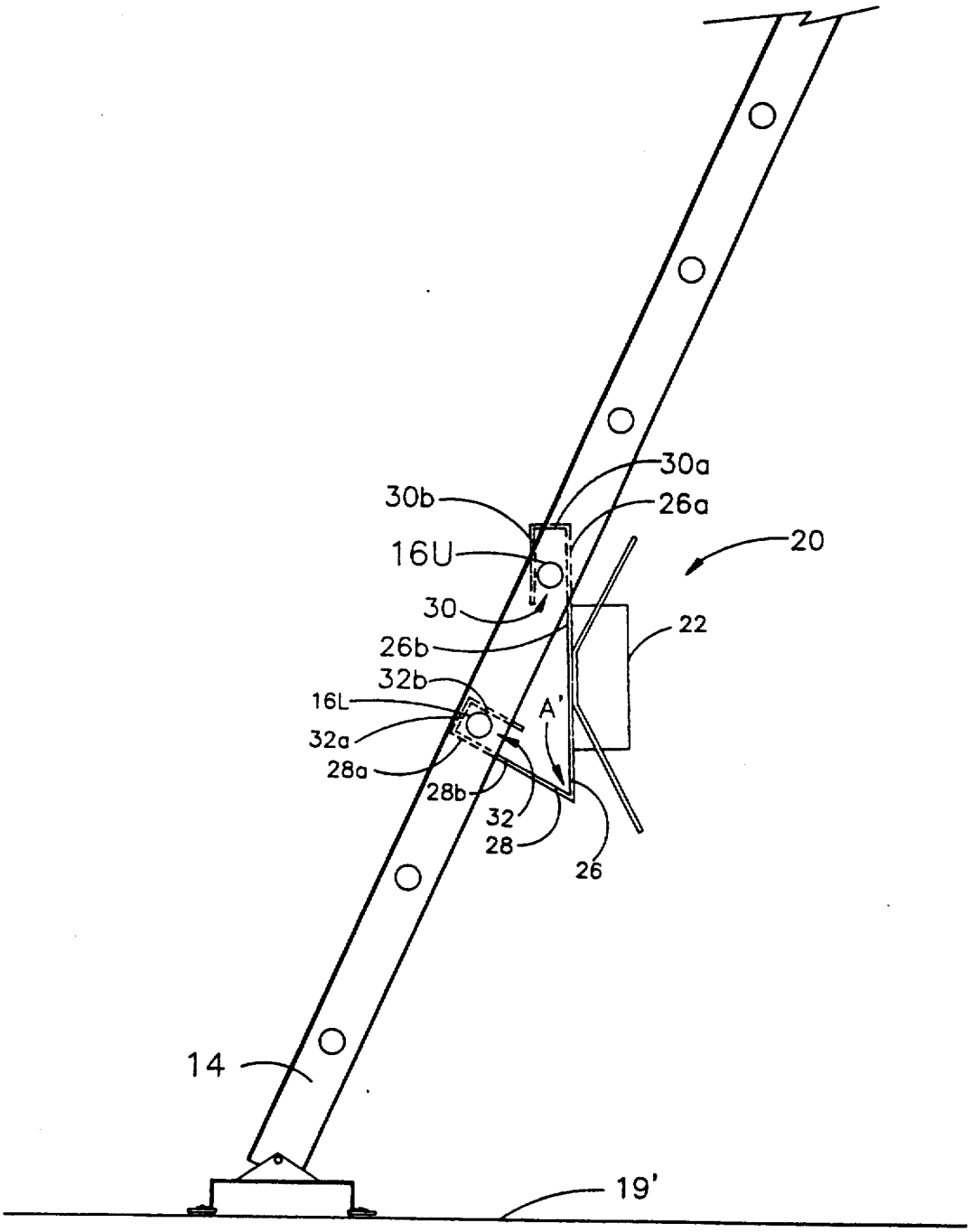
FIG. 25 is a side view illustrating the next consecutive step of the process of installing the winch mounting subassembly on a conventional ladder, and the final installed position of the winch mounting subassembly of the assembly invention.

The subassembly 20 is then swung or rotated as generally indicated at 31 in FIG. 22 to position the angular corner 29, or the corner comprising the angle of attachment 29 of the first wall 26 and the second wall 28 as further illustrated in FIG. 2, so that it lies opposite and below the lower rung 16L as best illustrated in FIG. 23. At this point the first wall 26 of the subassembly 20 is substantially parallel with diagonal surfaces of the ladder siderails 14, and the inside surface 26*b* of the first wall 26 of subassembly 20 comes to rest against the lower rung 16L of the consecutive pair of rungs 16CP selected for placement by the worker. The subassembly 20 is then raised diagonally along the rungs 16CP as indicated generally at 33 in FIG. 23 to position the angular corner 29 so that it is flush and fairly tightly against the lower rung 16L as best illustrated in FIG. 24. The subassembly 20 is then rotated or moved as generally indicated at 35 in FIG. 24 to a final position or installed position illustrated in FIG. 25 where the lower channeled slot 32 is seated at its complete depth against the lower rung 16L, against the short wall 32*a* of the lower slot 32, and the upper channeled slot 30 is supported, balanced and engaged by the upper rung 16U of rungs 16CP so that the short wall 30*a* of the upper slot 30 is supported above the upper rung 16U, spaced from and above this rung as illustrated in FIG. 25. Through the process of installing the subassembly 20 and the design and structure of the subassembly 20 itself, this subassembly supports the power winch unit 22 and the hoist line 24, as illustrated in FIG. 1 so that this unit 20 may properly take advantage of proper lifting angles to facilitate the lifting of an object 25 to be lifted from an installation surface 19'. Additionally, this allows the worker to more easily gain access and manipulate control of the winch machine unit 22 which is supported by the subassembly so that it is generally or substantially perpendicular to the installation surface 19', as illustrated in FIG. 25.

In choosing the type of power winch machine unit 22 to be mounted on the subassembly 20 and utilized with the invention 10, it will be understood that a number of diverse units 22 can be employed in combination with the invention 10. However the inventor has found that a general list of several makes and models of such units is suggested and has worked well in combination with the present invention.

For example, the "Dayton" power winch is one preferred brandname, of which the following catalog number for Dayton models is set forth in the W. W. Grainger Corp. Catalog, published out of Chicago, Ill. as catalog numbers 6X191, 6X190, 5W659, 5W660, 5W474, 4Z326 and 4Z327 for Additionally, "Porta-Power" Winchs manufactured by Allied Industrial Equipment of Knoxville, Tenn., or distributed therefrom, sells several models of power winchs which may be preferred in use with the present invention, including Model Numbers EP-1000, ESH-12HBM, EVS-190 and EVR-192. Also the "Ramsey" power winch, manufactured by Industrial Winch, Tulsa, Ok., provides several models, including Model Numbers REP4500, REP6000 and REP8000, as set forth in the Ramsey Catalog, which are recommended for use with the present invention 10.

Additionally, it will be understood that many other types and models of winch means may be employed in use and combination with the present invention assembly 10, including, and not limited to a hand crank devise or other devise powered by a DC or AC source, or other types of lifting devises which are compatable with the winch mounting subassembly 20.

Figure 8:
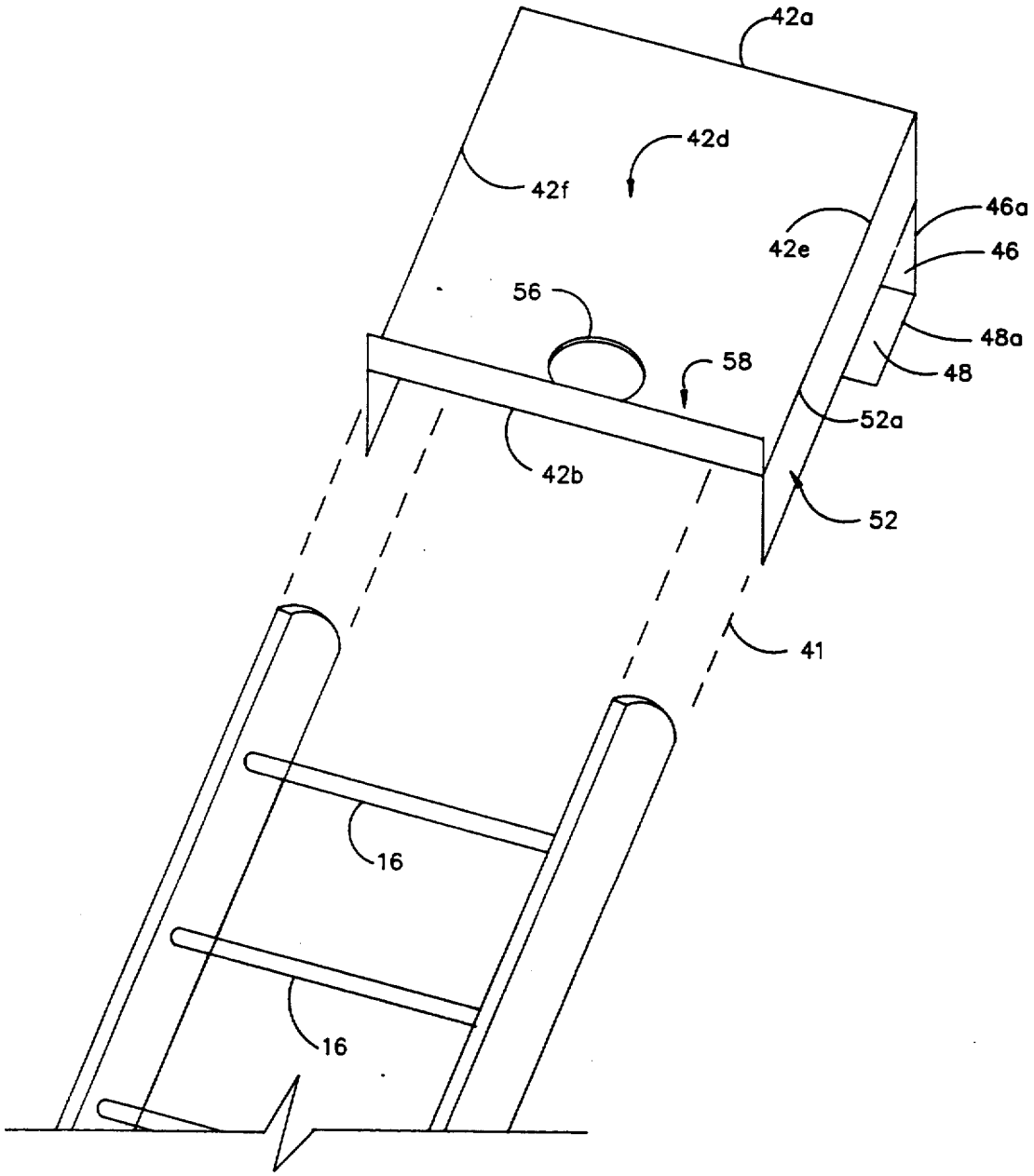
FIGS. 8, 9 and 10 are perspective views of the reversible mount bracket subassembly, showing in phantom the guided positional attachments and the secured position of the subassembly.
Figure 9:
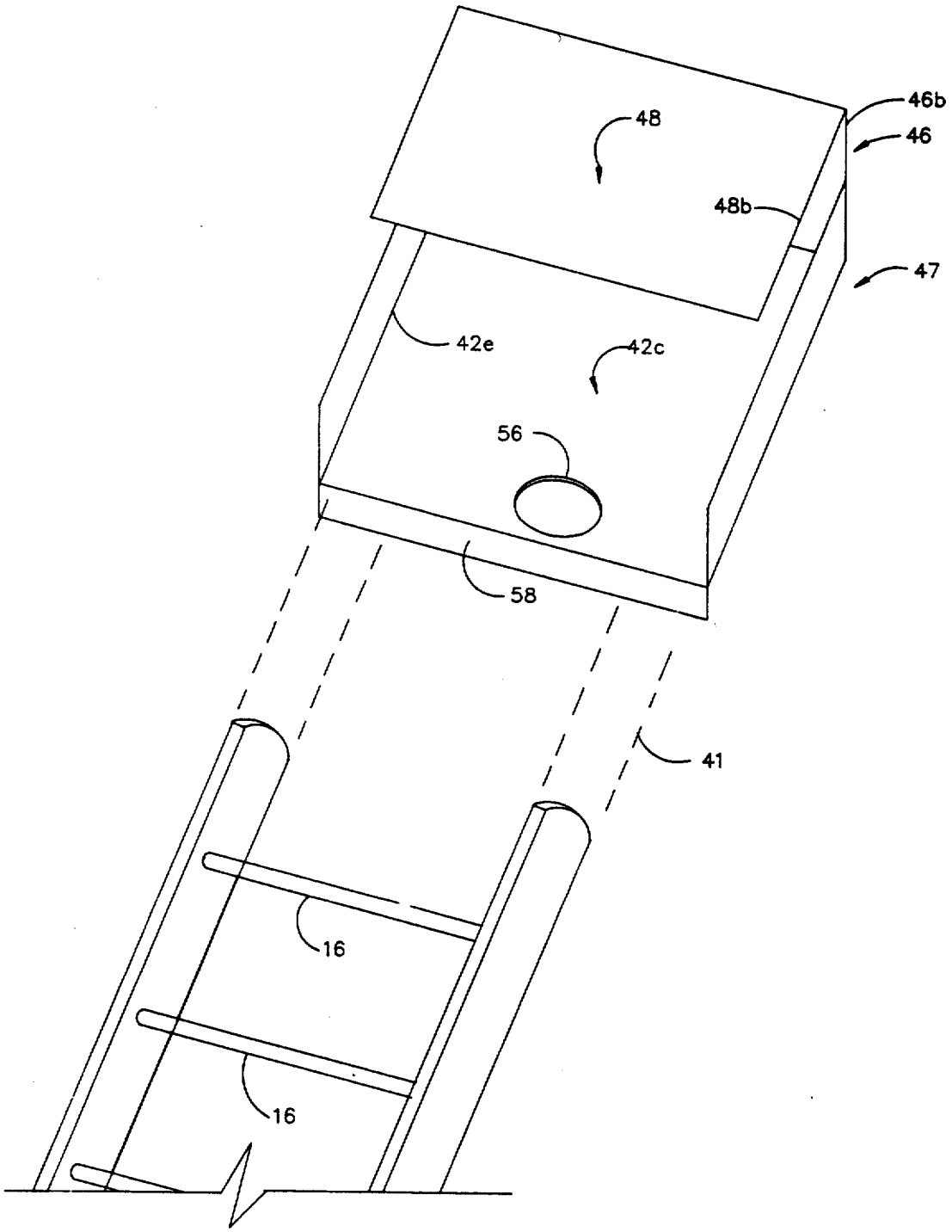
Figure 10:
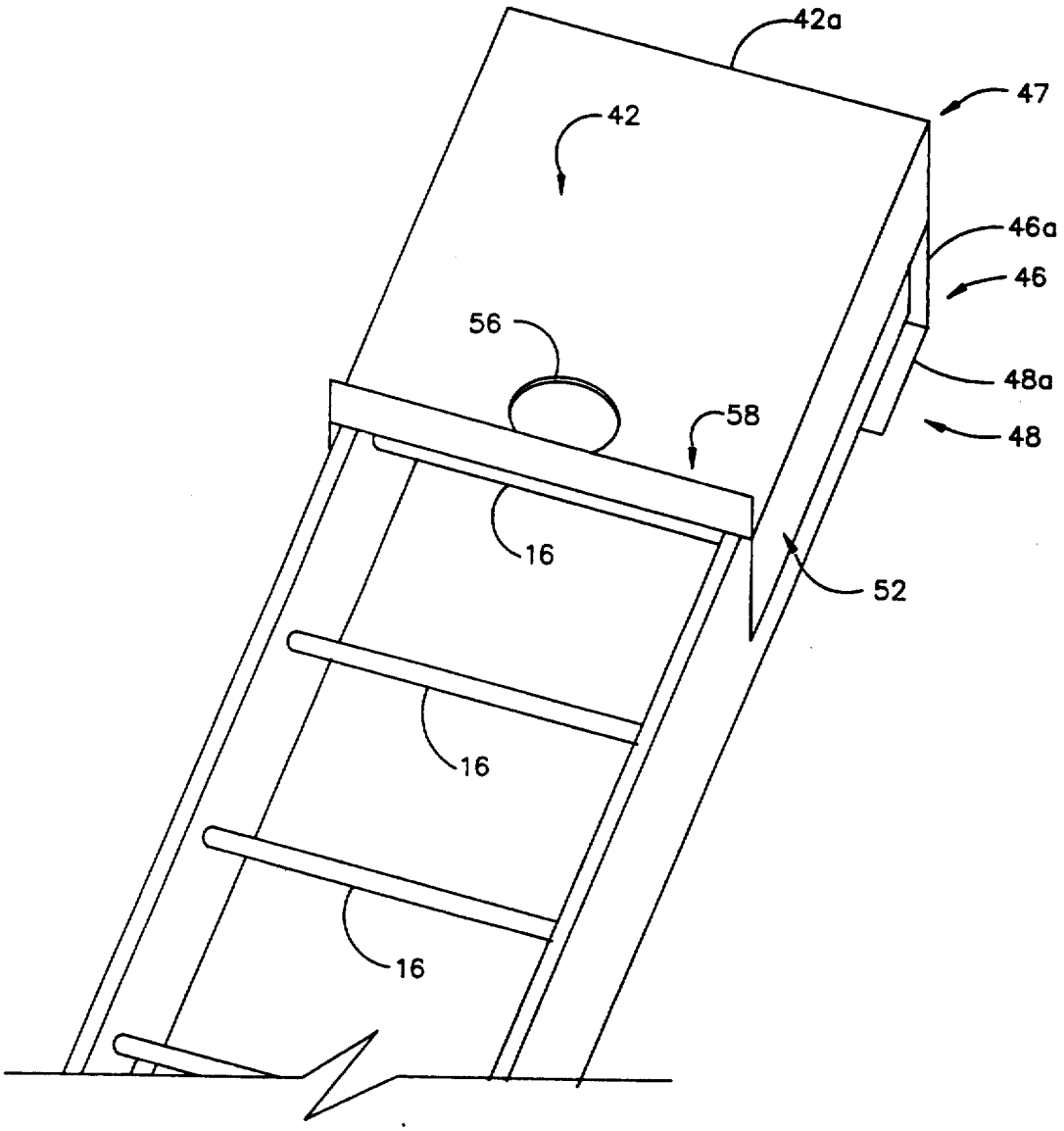

Referring back to FIGS. 4 through 10, and FIG. 1, the mount bracket subassembly 40 can be slid over the upper top portion of the siderails 14 of the ladder 12 into installed position as illustrated specifically in FIGS. 8, 9 and 10. By installing the mount bracket subassembly 40 in this manner, indicated generally in phantom 41, the outside surface 42*d* of the backmember 42 can be alternatively or reverseably positioned so that it faces either away from or toward a wall or side 18 of a building in its installed position on the ladder as illustrated in FIGS. 1, 8 and 9.

In referencing FIGS. 1, 11, 12 and 13, it is additionally noted that the second ends of the handle members 100*b* and 102*b* respectively of handle members 100 and 102, can be grasped by a worker for rotating or tilting the lower horizontal bar 66 for positioning the frame 62 and the safety rung support extension means 71 so that the first channel 86 of the support extension 71 can loopably secure and engage and support a selected rung 16 of a ladder 12, as illustrated in the the exploded upper section of FIG. 1. Also, the leg members 104 and 106 can be positioned as indicated by use of the handle members being manipulated 100 and 102, so that the legs 104 and 106 are positioned against a building roof surface 18' for supporting a ladder in a position extended away from the building roof surface 18' and the side 18 of a building, for lifting an object 25 by a hoist line 24 passing between the ladder 12 and the building side 18 up through the pulley unit 57 which is secured to the installed mount bracket subassembly 40, as illustrated in FIG. 1 for lifting an object which is heavier than average in weight in a more convenient and secure manner. Additionally, the worker can grasp the handle member 100 and 102 to assist in safely positioning a ladder 12 for different work purposes and required positions, and for disengaging the ladder rung 16 from the first channel 86 of the support extension 71 of the subassembly 60, for returning the ladder 12 to an initial starting or resting position against the side of a building as illustrated in FIG. 20, at 18.

In referencing FIGS. 4 through 10, it will additionally be noted that the rectangular security dock member 58 is used for providing support and stability in the event that it is necessary to place the second end of the back member 42 of the mount bracket subassembly 40 on any support surface intermittently in the process of installing the assembly 10, and for rotateably or otherwise engaging a rung 16 of a ladder 12 for helping to support the subassembly 40 from the second end 42*b* of the back member 42 in the event that the subassembly 40 moves for any reason from an intended installation position.

Additionally, the first security flap member 34 and the second security flap member 36 of the winch mounting subassembly 20 are used for security rung engagement purposes. The first security flap member 34 is used for loopably and otherwise engaging a rung 16 of a ladder 12 for supporting the subassembly 20 from the first wall 26 of this subassembly. The second security flap member 36 is used for loopably or otherwise engaging the rung 16 for supporting the subassembly 20 from the second wall 28 thereof.

While the present invention has been described in connection with the particular embodiments thereof, it will be understood that many changes and modifications of this invention may be made by those skilled in the art without departing from the true spirit and scope thereof. For example, other types and kinds of materials may be used for each of the subassemblies 20, 40, 60 and 110, such as molded rubber material or carbonaceous or graphite material. Accordingly, the appended claims are intended to cover all such changes and modifications as fall within the true spirit and scope of the present invention. The reader is requested to determine the scope of the invention by the appended claims and their legal equivalents, and not by the examples which have been given.

Having described my invention, I claim:

1. A ladder power winch assembly for attachment to a conventional ladder framework having two parallel spaced apart siderails transversely connected by a series of rungs extending from its lower-base end to its upper end at intervals of about twelve inches, and having a support foot pivotably attached to each siderail at its lower-base end for contact with a ground surface as a ladder is positioned against a vertically oriented wall surface extending to an elevated surface, said power winch assembly comprising:

a first stiffly resilient wall and a second stiffly resilient wall, each with inside and outside surfaces, with each of said walls being attached to one another so as to form angle A', the free end of said first wall defining an upper channeled slot parallel to its inside surface and the free end of said second wall defining a lower channeled slot parallel to its inside surface for loopable engagement respectively with an upper rung and a lower rung of a consecutive pair of rungs on a lower portion of a ladder such that the outside surface of said first wall faces a vertically oriented building wall surface upon which a ladder is supported, the outside surface of said first wall being substantially flat for fixed mounting of a motorized power winch means having a retractable hoist line for lifting an object;

a reversible mount bracket subassembly having:

a substantially flat, rigid back member having first and second ends, inside and outside surfaces and a pair of sides, a cantilevered portion having a support member and a projecting member, each with lateral surfaces parallel to the sides of said back member, the support member of said portion being integrally attached at its free end to the first end of said back member, such that the projecting member is parallel to the inside surface of the back member, said portion defining a channel for loopable engagement of a top-upper portion of a pair of siderails of a ladder, first and second guide walls, each being fixedly attached to a side of the back member, and extending perpendicular to the inside surface of said back member to a point substantially midway between the projecting member of said cantilevered portion and said back member, for slideably engaging and guiding the outside lateral side portions of a pair of siderails of a ladder to a fixed position inside said channel, said back member defining a space between the inside surface and the outside surface, proximate to the second end of said back, for releaseably attaching a pulley means for supportably and feedably transmitting a retractable hoist line from a power winch such that an object can be lifted from a ground surface upon which a ladder is supported against a wall surface of a building, for lifting an object to the upper end of a ladder so supported, whereby said mount bracket subassembly can be slideably installed over the upper portion of a pair of siderails of a ladder such that the outside surface of the back member can face either away from a wall of a building or toward a wall of a building; and a tiltable prop means subassembly having:

a stiffly resilient frame member having upper and lower horizontal bars and first and second side members, integrally connected along a common plane at each of four arcuate corners, said horizontal bars being parallel to each other, with said upper horizontal bar being shorter in length than said lower horizontal bar, and said first and second side members being of about equal length, a safety rung support extension means comprising:

a substantially flat support wall with first and second ends, inside and outside surfaces and first and second lateral surfaces, a first cantilevered portion having a support member and a projecting member, each with first and second coterminal lateral surfaces, the support member of said cantilevered portion being integrally attached at its free end to the first end of said support wall, said portion defining a first channel for loopably engaging and supporting the rung of a ladder, said cantilevered portion being fixedly attached to the upper horizontal bar of said frame above said frame and along the same plane as the frame for support thereof, said projecting member having a guide flap member integrally attached to the free end thereof, and extending away from the plane of the inside surface of said support wall at an acute angle B', for guiding a rung of a ladder toward supportable engagement by the first channel, a second cantilevered portion having a support member and a projecting member with first and second coterminal lateral surfaces, the support member of said second cantilevered portion being integrally attached at its free end to the second end of said support wall, said second portion defining a second channel for loopable engagement and secondary backup support and securance of a rung of a ladder in the event that a selected rung of a ladder slides out of supportable engagement by said first channel, a first handle member having first and second ends, the first end being fixedly attached to a side portion of said first side member of said frame at a point which is about halfway between the midpoint of the side member and the plane generated by the lower horizontal bar, a second handle member having first and second ends, the first end being fixedly attached to a side portion of said second side member at a point which is substantially coplanar with the plane generated by the point of attachment of said first handle on said first side member, such that said first and second handle members lie along parallel planes which are substantially perpendicular to the plane of the lower horizontal bar, a first leg member having first and second ends, said first end being fixedly attached to a side portion of said first side member of said frame such that the first leg extends along the same plane as the first handle member, substantially mirror-imaging the extension thereof, and a second leg member having first and second ends, said first end being fixedly attached to a side portion of said second side member at a point which is substantially coplanar with the plane generated by the point of attachment of said first leg on said first side member, and such that the second leg extends along the plane generated by the second handle member, substantially mirror-imaging the extension thereof, the second ends of said first handle member and said first leg member respectively, a midpoint between the points of attachment of said members on the first side member of said frame, and a point established by the plane of said lower horizontal bar, substantially forming a set of imaginery vertices of a rhomboidal figure when viewed from the first side member of the frame along the plane of the lower horizontal bar of said frame, the second ends of said second handle member and said second leg member, a midpoint between the points of attachment of said members on the second side member of said frame, and a point established by the plane of said lower horizontal bar, substantially forming a set of imaginery vertices of a rhomboidal figure when viewed from the second side member of the frame along the plane of the lower horizontal bar of said frame, whereby said tiltable prop means subassembly is self-supporting in a slanted, generally vertical position, when the frame is tilted by a worker to rest on the second ends of the first and second leg members, and similarly self-supporting when the frame is tilted by a worker to rest on the second ends of the first and second handle members, and whereby the second ends of said handle members can be grasped by a worker for rotating the lower horizontal bar for tiltably positioning the frame and the safety rung support extension means, such that the first channel of the support extension can loopably engage and support a selected rung of a ladder, and said leg members can be positioned against a building roof surface for supporting a ladder in a position extended away from a building roof surface for lifting an object by a hoist line therebetween for placement on a roof surface, and whereby a worker can grasp the handle members to assist in safely positioning a ladder, disengaging a ladder rung from the first channel of the support extension, and returning a ladder to an initial resting position against a building.

2. The ladder power winch assembly as recited in claim i, wherein:

said assembly further comprises a stabilizer means subassembly, positioned on a ground surface, for channelably engaging and securing a pair of support feet on the siderails of a conventional ladder, and providing fixed support against positional movement of a ladder along an x, y or z axis relative to an initial secured position of a ladder.

3. The ladder power winch assembly as recited in claim 2, wherein said stabilizer means comprises:

a substantially flat guide support member having first and second ends, a pair of lateral sides and inside and outside surfaces, a pair of cantilevered portions, each having a support wall and a projecting member and being integrally attached at a free end of said support wall to each of the lateral sides respectively of said guide support, said projecting member of each cantilevered portion being parallel with the vertical plane of the outside surface of said guide support and having base and further surfaces, said cantilevered portions defining a channel between said first and second ends of said guide support, said guide support defining a track engagement space between said inside and outside surfaces, equidistantly along a horizontal midpoint portion of said guide support, and defining a plurality of further spaces between said inside and outside surfaces along further evenly displaced portions of the horizontal length of said guide support, a substantially flat guide track member having first and second ends, a pair of side portions and inside and outside surfaces, and having a pair of cantilevered portions, each having a support wall and a projecting member, the free end of each of said support walls being integrally attached to each of said side portions respectively of said guide track member, and defining a guide channel on the inside surface of said guide track member between said first and second ends thereof, said side surface of said guide track member being engaged and inserted within the track engagement space of said guide support member such that the cantilevered portions of said guide track comes to insertably and fixably rest upon the horizontal sides of the engagement space for guidably receiving and supporting a pair of support feet of a conventional ladder within the guide support member, a pair of stiffly flexible support members having first and further ends, each support member being fixedly attached respectively to the first and second ends of said guide support member at its first end, and being fixedly attached to the siderails of a conventional ladder at its further ends, for laterally, vertically and horizontally supporting, in combination supportably with said guide track member and said guide support member, the siderails of a conventional ladder, and a plurality of stiffly compressable support pads, each spaced and fixedly attached at regular intervals along the outside surfaces of said profecting members of the cantilevered portions of said guide support member.

4. The ladder power winch assembly as recited in claim 3, wherein:

said winch mounting subassembly further comprises a first security flap member integrally attached to the free end of said first wall, and extending away from the outside surface of said first wall for loopably engaging a rung of a ladder for supporting the subassembly from the first wall thereof, and a second security flap member integrally attached at the free end of said second wall for loopably engaging a rung of a ladder for supporting the assembly from the second wall thereof.

5. The ladder power winch assembly as recited in claim 4, wherein:

said reversible mount bracket subassembly further comprises a rectangular security dock member fixedly attached at one of its long lateral sides to the second end of said back member, and extending away from the outside surface thereof at an approximate perpendicular angle, for providing support and stability in the event that it is necessary to place the second end of said back member on any support surface, and for rotateably engaging a rung of a ladder for helping to support the subassembly from the second end of said back in the event that the subassembly moves from an intended selected installation position.

6. The ladder power winch assembly as recited in claim 1, wherein:

acute angle A' of said winch mounting subassembly is equal to about 68 degrees to about 70 degrees, said first stiffly resilient wall has a length of about 17.5 inches, and defines an upper channeled slot parallel to the inside surface of said first wall, having a perpendicular depth or width of about 1.75 inches and a parallel length of about 5 inches, said second resilient wall has a length of about 7 inches, and defines a lower channeled slot parallel to the inside surface of said second wall, having a perpendicular depth or width of about 1.75 inches and a parallel length of about 3.5 inches, and the straight-lined distance between the free end of said first wall and the free end of said second wall opposite said acute angle A' is about 16 inches, such that the proportional relationship of the length of each element of the winch mounting subassembly when viewed from the side along the axis of the first wall, starting from the upper channeled slot, has a relative ratio of about 5:1.75:17.5:7: 1.75:3.5.

7. The ladder power winch assembly as recited in claim 6, wherein:

acute angle B' of the guide flap member of said first cantilevered portion of said safety rung support extension means is an angle equal to about 66 degrees to about 67 degrees.

8. The ladder power winch assembly as recited in claim 7 wherein:

the flat support wall of said safety rung support extension means has a length of about 12 inches and a width between lateral surfaces of about 12 inches, the support member of said second cantilevered portion of said extension means has a length of about 2.375 and a width of about 12 inches, the projecting member of said second cantilevered portion of said extension means has a length of about 1 inch, the support member of said first canilevered portion of said means has a length of about 2.375 inches and a width of about 12 inches, the projecting member of said first cantilevered portion of said means has a length of about 1 inch and a width of about 12 inches, and the guide flap member of the projecting member of said first cantilevered portion has a length of about 4 inches and a width of about 12 inches, such that the respective first and second lateral surfaces of the support wall and the first and second cantilevered portions are equally and parallely spaced from one another at a distance of about 12 inches.

9. A ladder having two parallel spaced apart siderails transversely connected by a series of rungs extending from its lower-base end to its upper end at intervals of about 12 inches; and a winch mounting subassembly having a first stiffly resilient wall and a second stiffly resilient wall, each with inside and outside surfaces, with each of said walls being integrally attached to one another at an angular corner having an acute angle A' which is equal to about 68 degrees to about 70 degrees, said first wall having a length of about 17.5 inches, the free end of said first wall defining an upper channeled slot parallel to the inside surface of said wall and having a perpendicular depth or width of about 1.75 inches and a parallel length of about 5 inches, said second wall having a length of about 7 inches, the free end of said second wall defining a lower channeled slot parallel to the inside surface of said wall and having a perpendicular depth or width of about 1.75 inches and a parallel length of about 3.5 inches, for engagement respectively with an upper rung and a lower rung of a consecutive pair of rungs of the ladder, the straight-lined distance between the free end of said first wall and the and the free end of said second wall opposite said angular corner being about 16 inches, the outside and inside surfaces of said first wall being substantially flat and parallel to one another for fixed mounting on said outside surface of a winch unit having a retractable hoist line for lifting an object;

wherein said winch mounting subassembly is attached to the ladder by a process comprising the steps of:

(1) positioning the subassembly to address a lower rung and an upper rung respectively of a selected consecutive pair of rungs of the ladder such that the lower channeled slot and the upper channeled slot face and address the lower rung and the upper rung respectively of the selected pair of rungs, (2) loopably engaging the upper channeled slot of the subassembly over the upper rung of the pair such that the upper rung seats securely against the perpendicular width of said channeled slot, (3) rotating the subassembly about the upper rung to position the angular corner of the subassembly such that it lies opposite and below the lower rung of said pair of rungs, wherein the first wall of said subassembly is substantially parallel to the siderails of the ladder and the inside surface of the first wall comes to rest against the lower rung of said pair, (4) positioning the subassembly along the parallel axis of the siderails of the ladder such that the angular corner is flushly and tightly engaged against the lower rung of said pair, and (5) moving the lower rung along the second wall of said subassembly, so positioned in the previous step, such that the lower channeled slot loopably and supportably engages said lower rung of said pair and the perpendicular width of said upper channeled slot is spaced above the upper rung, respectively, to balance and support the subassembly in final attached position.

10. A ladder power winch assembly for attachment to a ladder having two parallel spaced apart siderails transversely connected by a series of rungs extending from its lower-base end to its upper end at intervals of about twelve inches, and having a support foot pivotably attached to each siderail at its lower-base end for contact with a ground surface as a ladder is positioned against a vertically oriented wall surface extending to an elevated surface, said power winch assembly comprising:

a winch mounting subassembly having a first stiffly resilient wall and a second stiffly resilient wall, each with inside and outside surfaces, with each of said walls being attached to one another at an angular corner having an angle A', the free end of said first wall defining an upper channeled slot parallel to its inside surface and the free end of said second wall defining a lower channeled slot parallel to its inside surface for loopable engagement respectively with an upper rung and a lower rung of a consecutive pair of rungs on a ladder such that the outside surface of said first wall faces a vertically orient-ed building wall surface upon which a ladder is supported, said subassembly further having a first security flap member attached to the free end of said first wall, and extending away from the outside surface of said first wall for loopably engaging a rung of a ladder for supporting the subassembly from the first wall thereof, and a second security flap member attached at the fee end of said second wall for loopably engaging a rung of a ladder for supporting the assembly form the second wall thereof, and said angular corner of said walls having an angle equal to from about 68 degrees to about 70 degrees, the straight-lined distance between the free end of said first wall and the free end of said second wall opposite said angular corner being about 16 inches;

a reversible mount bracket subassembly having:

a substantially flat, rigid back member having first and second ends, inside and outside surfaces and a pair of sides.

a cantilevered portion having a support member and a projecting member, each with lateral surfaces parallel to the sides of said back member, the support member of said portion being attached at its free end to the first end of said back member, such that the projecting member is parallel to the inside surface of the back member, said portion defining a channel for loopable engagement of a top-upper portion of a pair of the siderails of a ladder, first and second guide walls, each being fixedly attached to a side of the back member, and extending perpendicular to the inside surface to said back member to a point substantially midway between the projecting member of said cantilevered portion and said back member, for slideably engaging and guiding the outside lateral side portions of a pair of siderails of a ladder to a fixed position inside said channel, said back member defining a space between the inside surface and the outside surface thereof, for releaseably attaching a pulley unit means for supportably and feedably transmitting a retractable hoist line from a power winch unit such that an object can be lifted from a ground surface upon which a ladder is supported to the upper end of a ladder, whereby said mount bracket subassembly can be slideably installed over the upper portion of a pair of siderails of a ladder such that the outside surface of the back member can face either away from a wall of a building or toward a wall of a building, and a rectangular security dock member fixedly attached at one one of its long lateral sides to the second end of said back member, and extending away from the outside surface thereof at an approximate perpendicular angle, for providing support and stability in the event that it is necessary to place the second end of said back member on any support surface for support thereof, and for rotateably engaging a rung of a ladder for helping to support the subassembly from the second end of said back member in the event that the subassembly moves form an intended, selected installation position;

a tiltable prop means subassembly having:

a stiffly resilient frame member having upper and lower horizontal bars and first and second side members, attached along a common plane at each of four corners, said horizontal bars being parallel to each other, with said upper horizontal bar being shorter in length than said lower horizontal bar, and said first and second side members being of about equal length, such that the frame has a general configuration of an isosceles trapezoid, a safety rung support extension means comprising:

a substantially flat support wall with first and second ends, inside and outside surfaces and first and second lateral surfaces, a first cantilevered portion having a support member and a projecting member, each with first and second coterminal lateral surfaces, the support member of said cantilevered portion being attached at its free end to the first end of said support wall, said portion defining a first channel for loopably engaging and supporting the rung of a ladder, said cantilevered portion being fixedly attached to the upper horizontal bar of said frame above said frame and in axial alignment with said frame for support thereof, said projecting member having a guide flap member attached to the free end thereof, and extending away from the plane of the inside surface of said support wall at an angle B' for guiding a rung of a ladder toward supportable engagement by the first channel, the angle B' being equal to from about 66 degrees to about 67 degrees, a second cantilevered portion having a support member and a projecting member with first and second coterminal lateral surfaces, the support member of said second cantilevered portion being attached at its free end to the second end of said support wall, said second portion defining a second channel for loopable engagement and secondary backup support and securance of a rung of a ladder in the event that a selected rung of a ladder is positioned out of supportable engagement with said first channel, a first handle member having first and second ends, the first end being fixedly attached to a side portion of said first side member of said frame at a point which is about halfway between the midpoint of the side member and the plane generated by the lower horizontal bar, a second handle member having first and second ends, the first end being fixedly attached to a side portion of said second side member at a point which is substantially coplanar with the plane generated by the point of attachment of said first handle on said first side member, parallel to said lower horizontal bar, such that said first and second handle members lie along parallel vertical planes which are substantially perpendicular to the horizontal plane of the lower horizontal bar, a first leg member having first and second ends, said first end being fixedly attached to a side portion of said first side member of said frame such that the first leg is coplanar with the first handle member, substantially mirror-imaging the extension thereof, and a second leg member having first and second ends, said first end being fixedly attached to a side portion of said second side member at a point which is substantially coplanar with the horizontal plane generated by the point of attachment of said first leg on said first side member, and such that the second leg extends along the vertical plane generated by the second handle member, substantially mirror-imaging the extension thereof, the second ends of said first handle member and said first leg member respectively, a midpoint between the points of attachment of said members on the first side member of said frame, and a point established by the horizontal plane of said lower horizontal bar, substantially forming a set of imaginery vertices of a rhombus when viewed from the first side member of the frame along the horizontal plane of the lower horizontal bar of said frame, the second ends of said second handle member and said second leg member, a midpoint between the points of attachment of said members on the second side member of said frame, and a point established by the horizontal plane of said lower horizontal bar, substantially forming a set of imaginery vertices of a rhombus or equilateral parallelogram when viewed from the second side member of the frame along the horizontal plane of the lower horizontal bar of said frame, whereby said tiltable prop means subassembly is self-supporting in a slanted, generally vertical position, when the frame is tilted by a worker to rest on the second ends of the first and second leg members, and similarly self-supporting when the frame is tilted by a worker to rest on the second ends of the first and second handle members, and whereby the second ends of said handle members can be grasped by a worker for rotating the lower horizontal bar for tiltably positioning the frame and the safety rung support extension means, such that the first channel of the support extension can loopably engage and support a selected rung of a ladder, and said leg members can be posited against a building roof surface for supporting a ladder in a position extended away from a building roof surface and the side of a building for lifting an object by a hoist line therebetween for placement on a roof surface, and whereby a worker can grasp the handle members to assist in safely positioning a ladder, disengaging a ladder rung from the first channel of the support extension, and returning a ladder to initial resting position or first position against a building; and a stabilizer means subassembly, positioned on a ground surface for channelably engaging and securing a pair of support feet on the siderails of a ladder, and providing fixed support against positional movement of a ladder along an x, y or z axis relative to an initial secured position of a ladder, said stabilizer subassembly comprising:

a substantially flat guide support member having first and second ends, a pair of lateral sides and inside and outside surfaces, a pair of cantilevered portions, each having a support wall and a projecting member and being attached at a free end of said support wall to each of the lateral sides respectively of said guide support, said projecting member of each cantilevered portion being parallel with the vertical plane of the outside surface of said guide support and having base and further surfaces, said cantilevered portions defining a channel between said first and second ends of said guide support, said guide support defining a track engagement space between said inside and outside surfaces, equidistantly along a horizontal midpoint portion of said guide support, and defining a plurality of further spaces between said inside and outside surfaces along further evenly displaced portions of the horizontal length of said guide support, a substantially flat guide track member having first and second ends, a pair of side portions and inside and outside surfaces, and having a pair of cantilevered portions, each having a support wall and a projecting member, the free end of each of said support walls being attached to each of said side portions respectively of said guide track member, and defining a guide channel on the inside surface of said guide track member between said first and second ends thereof, said guide track member being engaged and inserted within the track engagement space of said guide support such that the cantilevered portions of said guide track biasingly engage and attach to the horizontal sides of the engagement space in secured position for guidably receiving and supporting a pair of support feet of a ladder in combination with the guide support member, a pair of stiffly flexible support members having first and further ends, each support member being fixedly attached respectively to the first and second ends of said guide support member at its first end, and fixedly attached to the siderails of a ladder at its further ends, respectively, for laterally, vertically and horizontally supporting, in combination supportably with said guide track member and said guide support member, the siderails of a ladder, and a plurality of stiffly compressable support pads, spaced and fixedly attached along the outside surface and horizontal length of the projecting members of each of the cantilevered portions of the guide support member.

* * * * *

UNITED STATES PATENT AND TRADEMARK OFFICE

CERTIFICATE OF CORRECTION

PATENT NO. : 5,139,108

DATED : August 18, 1992

INVENTOR(S) : Ivan G. Pate

It is certified that error appears in the above-indentified patent and that said Letters Patent is hereby corrected as shown below:

At Col. 19, line 33, Claim 1, insert before "a first stiffly resilient wall", the following: --a winch mounting subassembly having--.

At Col. 21, lines 64-65, Claim 2, delete "The ladder power winch assembly as recited in claim i, wherein:", and insert --The ladder power winch assembly as recited in claim 1, wherein:--.

Signed and Sealed this

Sixteenth Day of May, 1995

*Attest:*

Bruce Lehman

BRUCE LEHMAN

*Attesting Officer*

*Commissioner of Patents and Trademarks*